US007835684B2

(12) United States Patent
Heimbach et al.

(10) Patent No.: US 7,835,684 B2
(45) Date of Patent: Nov. 16, 2010

(54) METHOD AND DEVICE FOR CONTROLLING AN ELECTROGRAPHIC PRINTER OR COPIER

(75) Inventors: Robert Heimbach, Poing (DE); Rainer Katterloher, Dorfen (DE); Stephan Pilsl, Röhrmoos (DE); Stefan Zimprich, Ismaning (DE); Christian Ferti, Pfaffing (DE); Werner Zollner, Eitting (DE); Christoph Nemmaier, München (DE); Helmut Sippel, München (DE); Hubert Drexler, Taufkirchen (DE)

(73) Assignee: Oce Printing Systems GmbH, Poing (DE)

( * ) Notice: Subject to any disclaimer, the term of this patent is extended or adjusted under 35 U.S.C. 154(b) by 1035 days.

(21) Appl. No.: 10/532,293

(22) PCT Filed: Oct. 16, 2003

(86) PCT No.: PCT/EP03/11488

§ 371 (c)(1),
(2), (4) Date: Dec. 20, 2005

(87) PCT Pub. No.: WO2004/040379

PCT Pub. Date: May 13, 2004

(65) Prior Publication Data

US 2006/0239699 A1 Oct. 26, 2006

(30) Foreign Application Priority Data

Oct. 28, 2002 (DE) ..... 102 50 194

(51) Int. Cl.
*G03G 15/00* (2006.01)

(52) U.S. Cl. ..... 399/396; 399/394

(58) Field of Classification Search ..... 399/396
See application file for complete search history.

(56) References Cited

U.S. PATENT DOCUMENTS

| | | | | |
|---|---|---|---|---|
| 4,318,176 | A * | 3/1982 | Stratton et al. | 700/125 |
| 4,475,156 | A | 10/1984 | Federico et al. | |
| 4,589,765 | A | 5/1986 | Perun et al. | |
| 4,591,884 | A | 5/1986 | Miyamoto et al. | |
| 4,621,801 | A * | 11/1986 | Sanchez | 271/251 |
| 4,804,998 | A | 2/1989 | Miyawaki | |

(Continued)

FOREIGN PATENT DOCUMENTS

| | | |
|---|---|---|
| EP | 0 810 484 | 12/1997 |

(Continued)

*Primary Examiner*—Anthony H. Nguyen
(74) *Attorney, Agent, or Firm*—Schiff Hardin LLP

(57) ABSTRACT

In a method for control of an electrophotographic printer or copier, information that refer to a single sheet are determined from print data supplied to the printer or copier. Dependent on said information, a transport path of the single sheet through the printer or copier to generate at least one print image on at least one side of the sheet is determined. A system time of the printer or copier is provided that is the same for at least first and second control units of the printer or copier. At least one desired point in time at or until which at least one sensor signal is expected or at least one actuator is activated is established dependent on the transport path, the desired point in time referring to the system time of the printer or copier.

4 Claims, 15 Drawing Sheets

U.S. PATENT DOCUMENTS

| | | | | |
|---|---|---|---|---|
| 5,374,045 | A | 12/1994 | Milillo | |
| 5,449,166 | A | 9/1995 | Lohmann et al. | |
| 5,479,240 | A | 12/1995 | Lee et al. | |
| 5,489,969 | A | 2/1996 | Solar et al. | |
| 5,598,257 | A | 1/1997 | Keller et al. | |
| 5,699,165 | A * | 12/1997 | Suzuki et al. | 358/296 |
| 5,826,157 | A | 10/1998 | Wierszewski | |
| 6,101,364 | A | 8/2000 | Boehmer et al. | |
| 6,212,357 | B1 | 4/2001 | Boehmer et al. | |
| 6,269,237 | B1 | 7/2001 | Olbrich et al. | |
| 6,311,972 | B1 | 11/2001 | Carter | |
| 6,687,022 | B1 * | 2/2004 | Lapstun et al. | 358/1.9 |

FOREIGN PATENT DOCUMENTS

| | | |
|---|---|---|
| JP | 3-119854 | 5/1991 |
| JP | 3-213371 | 9/1991 |
| JP | 5-105255 | 4/1993 |
| JP | 08-036282 | 2/1996 |
| JP | 2001-100475 | 4/2001 |
| WO | WO 98/10845 | 3/1998 |
| WO | WO 98/18052 | 4/1998 |
| WO | WO 98/18060 | 4/1998 |

* cited by examiner

| Valve | Function |
|---|---|
| Side nozzle V3 | Detach uppermost sheet |
| Front nozzle V2 | Reject following sheets |
| Suction chamber V1 | Separate sheet |
| Start of the suction belt | Paper transport |

| Sheet Nr. | How to print | Associated path | Note | Re-evaluation | Operating mode |
|---|---|---|---|---|---|
| 1 | one-sided | DW74 | Insofar as sufficiently many sheets follow, alternate printing on DW74 and DW76 is optimal | | BA2 |
| 2 | one-sided | DW76 | | | BA2 |
| 3 | one-sided | DW74 | | | BA2 |
| 4 | two-sided | Duplex | | | BA1 |
| 5 | one-sided | Duplex | Tentative coordination: Should the sequence be long enough, it is re-evaluated (see sheet Nr. 14) | DW74 with large sheet separation from sheet Nr. 4 | BA2 |
| 6 | one-sided | Duplex | | DW76 | BA2 |
| 7 | one-sided | Duplex | | DW74 | BA2 |
| 8 | one-sided | Duplex | | DW76 | BA2 |
| 9 | one-sided | Duplex | | DW74 | BA2 |
| 10 | one-sided | Duplex | | DW76 | BA2 |
| 11 | one-sided | Duplex | | DW74 | BA2 |
| 12 | one-sided | Duplex | | DW76 | BA2 |
| 13 | one-sided | Duplex | | DW74 | BA2 |
| 14 | one-sided | DW76 | With registration of this sheet, the sequence is long enough, re-evaluate from sheet 5 | | BA2 |
| 15 | one-sided | DW74 | | | BA2 |
| 16 | two-sided | Duplex | End of the sequence | | BA1 |
| 17 | two-sided | Duplex | | | BA1 |
| 18 | two-sided | Duplex | | | BA1 |

Fig. 15

METHOD AND DEVICE FOR CONTROLLING AN ELECTROGRAPHIC PRINTER OR COPIER

BACKGROUND

The preferred embodiment concerns methods and devices for control of an electrographic printer or copier as well as an electrographic printer or copier.

Known electrographic printers or copiers comprise a plurality of sensors (such as, for example, light barriers and switches) to monitor the paper path. Furthermore, these known printers contain a plurality of actuators such as, for example, servo motors, step motors, valves and solenoids, whereby at least with some actuators the servo position of the actuator is monitored with the aid of a position feedback. The paper path of a single sheet to be printed by the printer is controlled with the aid of the actuators and monitored with the aid of the sensors. Furthermore, the sensors are used in order to control between successive single sheets to be printed and to determine control time points. Thus in known printers or copiers at least one light barrier is arranged directly in front of a printing group in order to start the printing process of the printing group when the leading edge of the sheet has reached the light barrier. It should thereby be achieved that the print image is correctly transfer printed on the supplied side of the single sheet.

To establish a paper jam, in known printers it is monitored how long a sensor signal that is triggered by a page present in the sensor region is present. If this time exceeds a predetermined limit value, it is assumed that the paper is jammed in the region of the sensor. In known printers or copiers, the time that a single sheet needs after passing a first sensor until arriving at a second sensor is also recorded. If this time exceeds a preset limit value, it is assumed that the single sheet is still located between the two sensors and a paper jam has occurred. In known printers or copiers, the actuators are activated according to a control schema dependent on sensor signals.

Depending on the operating type of the printer or copier, a predetermined sheet separation is to be set between successive single sheets to be printed. To set the sheet separation, the sheet separation between two single sheets is measured, whereby given a deviation from a preset sheet separation the sheet separation for subsequent single sheets is controlled dependent on the deviation. Thus a plurality of time observations of single sheets is controlled dependent on the deviation. In these known printers or copiers, a plurality of time observations of relative times are thus necessary that intervene in the individual control workflows and are provided by the controllers of the structural groups of the printer or copier. In particular in high-capacity printers and high-capacity copiers with a printing or copying speed of ≧50 sheet DIN A4 per minute with a plurality of paper paths, a plurality of sensors and actuators are necessary in order to ensure both the high printing speed and a high print quality. Very elaborate and powerful controllers are in particular necessary for these high-capacity printers copiers. Further sensors are necessary in order to further improve the print quality of these printers or copiers and primarily in order to further increase the printing speed, whereby the evaluation of the sensor signals must occur with a higher precision with increasing printing speed of the printer or copier. However, these complex control tasks are only to be realized with a significant effort.

Such known high-capacity printers are, for example, specified in the international patent applications WO/18054 and WO98/18052, from which a high-capacity printer with two printing groups for printing of single sheets is known. The described printers can be operated in at least two operating modes, whereby the transport path of the single sheet through the printer is established by the operating mode. The printers have a plurality of sensors and actuators for control of the paper transport and of the printing process.

SUMMARY

It is an object to specify methods and devices for control of a printer in which complex control events can also be realized relatively simply and with a high precision in the printer or copier. Furthermore, it is an object to specify an electrographic printer or copier that can be operated in at least two operating modes and has a high performance in the printing of single sheets.

In a method for control of an electrophotographic printer or copier, information that refer to a single sheet are determined from print data supplied to the printer or copier. Dependent on said information, a transport path of the single sheet through the printer or copier to generate at least one print image on at least one side of the sheet is determined. A system time of the printer or copier is provided that is the same for at least first and second control units of the printer or copier. At least one desired point in time at or until which at least one sensor signal is expected or at least one actuator is activated is established dependent on the transport path, the desired point in time referring to the system time of the printer or copier.

BRIEF DESCRIPTION OF THE DRAWINGS

FIG. 15 is a table in which is shown a workflow upon switching of the operating modes.

DESCRIPTION OF THE PREFERRED EMBODIMENT

Figure 1:
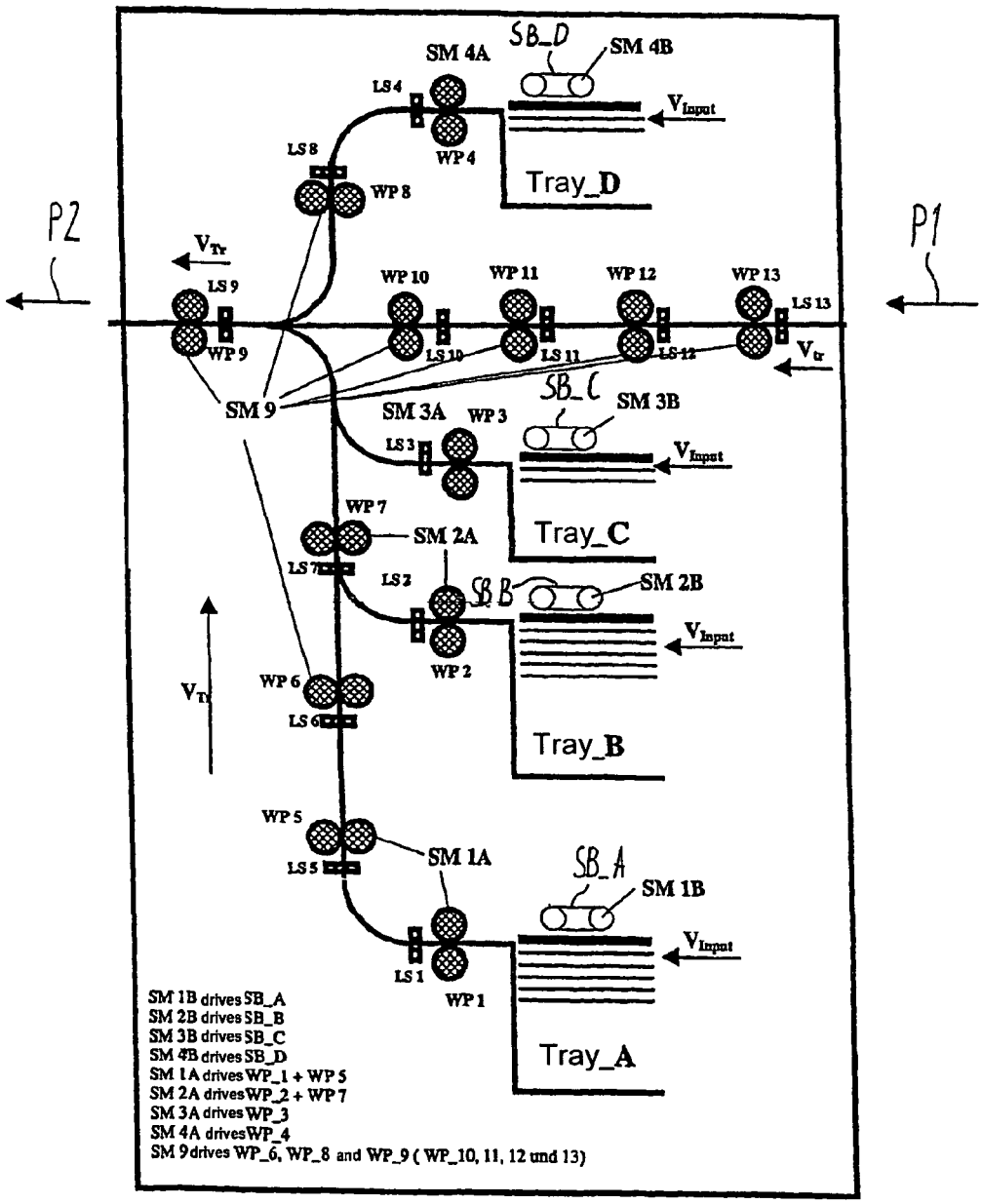
FIG. 1 shows the schematic design of a feeder unit of a printer or copier.

For the purposes of promoting an understanding of the principles of the invention, reference will now be made to the preferred embodiment illustrated in the drawings and specific language will be used to describe the same. It will nevertheless be understood that no limitation of the scope of the invention is thereby intended, such alterations and further modifications in the illustrated device, and/or method, and such further applications of the principles of the invention as illustrated therein being contemplated as would normally occur now or in the future to one skilled in the art to which the invention relates.

Via a method for control of an electrographic printer or copier of the preferred embodiment, it is achieved that the desired point in time at which or until which at least one sensor signal is expected can already be determined before the control event for transport of the single sheet through the printer or copier has been started. The control units of the printer or copier thus no longer have to determine desired times during the control event. If the desired point in time is monitored with the aid of a separate time controller, the remaining controllers of the printer or copier can be significantly unloaded of monitoring of the desired times. It is advantageous to relate the desired point in time to a time normal of the printer or copier, for example to the system time. A reaching or excess of the desired point in time can thereby be monitored simply and with less effort.

A second aspect of the preferred embodiment concerns a device for control of an electrographic printer or copier that determines single-sheet-related information from the print data supplied to the printer or copier. The controller determines the transport path of the single sheet through the printer or copier for generation of at least one print image on at least one side of the single sheet dependent on the single-sheet-related information. Dependent on the transport path, the controller establishes at least a desired point in time at which at least one sensor signal is to be expected and/or at least one actuator is to be activated. The desired point in time is related to a time normal of the printer or copier.

It is thereby achieved that the desired points in time can already be determined before the control of the transport of the single sheet through the printer or copier, whereby the controller or the controllers of the printer or copier neither establish nor monitor the desired points in time during the actual control event and are thereby unloaded. Since the desired point in time is related to a time normal (for example to the system time) of the printer or copier, the desired point in time can be simply monitored with the aid of a time controller. The controller of the printer or copier for control of the single sheet along the transport path is thus unloaded of determination and monitoring of the desired point in time. The determination and monitoring of the desired point in time requires significant resources of the controller, in particular in high-capacity printers with a printing speed of ≧50 sheet DIN A4 per minute. In the device of the preferred embodiment, the controller is at least unloaded during the control event since the desired point in time does not have to be determined during the control event, but rather can already be determined before the feed of the single sheet. Via this device it is likewise possible in a simple manner to implement the monitoring of the desired point in time with the aid of a simple time control unit of the printer or copier. The printer controller is thus also unloaded of the monitoring of the desired point in time. Upon reaching and/or upon exceeding the desired point in time, the time control unit then outputs a signal to the printer controller.

According to a third aspect of the preferred embodiment, a method is specified for control of an electrographic printer or copier. In a first operating mode for double-sided printing of a first single sheet, a print image is generated on the front side of the first single sheet with the aid of a first printing group and a print image is generated on the back side of the first single sheet with the aid of a second printing group. The single sheet is supplied on a first transport path to the first printing group and the second printing group. In a second operating mode for one-sided printing of single sheets, a print image is generated on the front side of a second single sheet with the aid of the first printing group and a print image is generated on the front side of a third single sheet with the aid of a second printing group. The second single sheet is supplied to the first printing group on a second transport path and the third single sheet is supplied to the second printing group on a third transport path. In the method, a switch is made from the first operating mode to the second operating mode when a specific number of successive individual sheets that are to be printed one-sided is achieved or exceeded. It is thereby achieved that one-sided single sheets to be printed are also printed in the first operating mode when the printing of these single sheets in the second operating mode takes up more time (including the switch-over event) than the one-sided printing of these single sheets in the first operating mode. The performance of the printer or copier can thus be increased, whereby the wear of structural elements stressed in the change of operating modes is reduced.

A fourth aspect of the preferred embodiment concerns an electrographic printer or copier that, in a first operating mode for double-sided printing of a first single sheet, generates a print image on the front side of the first single sheet with the help of a first printing group and generates a print image on the back side of the first single sheet with the help of a second printing group. The single sheet is supplied to the first and the second printing group on a first transport path. In a second operating mode for one-sided printing of single sheets, a print image is generated on the front side of a second single sheet with the aid of the first printing group and a print image is generated on the front side of a third single sheet with the aid of the second printing group. The second single sheet is supplied to the first printing group on a second transport path and the third single sheet is supplied to the second printing group on a third transport path. The printer then only changes (with the aid of a controller) from the first operating mode to the second operating mode when a preset number of successive single sheets are to be printed one-sided.

It is thereby achieved that a frequency switch-over between the operating modes of the printer or copier is avoided, whereby in particular the wear of the switch-over components is low. Furthermore, the printing speed of the printer or copier is increased when the time for the switch-over from the first operating type to the second operating type, the printing of the one-sided single sheets to be printed in the second operating mode and the change from the second operating mode to the first operating mode requires more time than the one-sided printing of the one-sided single sheets to be printed in the first operating mode. The performance of the printer or copier can thereby be increased.

According to a fifth aspect of the preferred embodiment a method is specified for control of an electrographic printer or copier in which single sheets are printed by at least one printing group. The single sheets are conveyed through the printer or copier and supplied to the printing group on at least one transport path. The arrival time of a first single sheet at a first measurement point is determined as a first real point in time and compared with a first desired point in time. The transport speed of the first single sheet is increased, reduced or maintained on at least a portion of the transport path dependent on the deviation of the first real point in time from the first desired point in time. The arrival time of a second single sheet at the measurement point is also determined as a second real point in time and compared with a second desired point in time. The transport speed of the second single sheet is increased, reduced or maintained on at least a portion of the transport path dependent on the deviation of the second real point in time from the second desired point in time. It is thereby achieved that the distance between the first single sheet and the second single sheet can be set exactly. Very small sheet separations can thereby also be set exactly, whereby the printing speed of the printer or copier is increased and the precision upon generation of the print images is improved.

According to a sixth aspect of the preferred embodiment, a device is specified for control of an electrographic printer or copier in which the arrival time of a first single sheet conveyed by a transport device is determined at a measurement point as a first real point in time. A control unit compares the first real point in time with a first desired point in time and controls the transport speed of the first single sheet in a region after the measurement point. The control unit increases, reduces or maintains the transport speed of the first single sheet on at least a portion of the region dependent on the deviation of the first real point in time from the first desired point in time. The measurement device determines the arrival time at the measurement point of a second single sheet transported by the transport device as a second real point in time. The control unit compares the second real point in time with a second desired point in time and controls the transport speed of the second single sheet in a region after the measurement point. The control unit increases, reduces or maintains the transport speed of the second single sheet on at least a portion of the transport path dependent on the deviation of the second real point in time from the second desired point in time. It is thereby achieved that the sheet separation between the first and the second single sheet is set exactly and very small sheet separations can be set precisely. The printing speed of the printer or copier can be increased via the possibility of setting such small sheet separations. Furthermore, an exact positioning of the print image on the single sheet is possible in a simple manner via the exact positioning of the first and the second side. The performance of the printer or copier is thus increased and the print quality is improved.

A feeder unit of a high-capacity printer with a printing speed of up to 160 sheet DIN A4 per minute is shown in FIG. 1. The feeder unit has four reservoir trays Tray_A, Tray_B, Tray_C, Tray_D from which single sheets are alternately extracted. Furthermore, the feeder unit can be supplied with single sheets in the direction of the arrow P1 from a subsequent feeder unit (not shown). These supplied single sheets are transported until the light barrier LS9 with the aid of the roller pairs WP13, WP12, WP11, WP10. The single sheet is subsequently transported into the printer (not shown) in the direction of the arrow P2 with the aid of the roller pair WP9. The roller pairs WP9 through WP 12 are driven by a step motor SM9, such that the single sheet is conveyed by the feeder unit with a constant speed $V_{TR}$.

A stack with single sheets of a preset paper format is respectively present in the reservoir trays Tray_A, Tray_B, Tray_C, Tray_D. The reservoir trays Tray_A, Tray_B, Tray_C, Tray_D respectively comprise a transport system that raises the stack of single sheets located in the respective reservoir tray such that the uppermost sheet of the respective stack is arranged at a predetermined height below the suction belt SB_A through SB_D of the reservoir tray Tray_A through Tray_D. The suction belt SB_A is driven with the aid of the step motor SM1B for extraction of a page from the reservoir tray Tray_A such that the uppermost single sheet is supplied to the roller pair WP1, whereby the suction belt SB_A accelerates the single sheet to a transport speed $V_{INPUT}$. The single sheet is forwarded with the speed $V_{INPUT}$ with the aid of the roller pair WP1. The point in time of the arrival of the single sheet at the light barrier LS1 is detected and compared with a desired point in time previously established for this single sheet and this light barrier LS1. Dependent on the comparison result of the arrival time of the single sheet at the light barrier LS1 and the predetermined desired point in time, the point in time is determined at which the transport speed of the single sheet is reduced from the feed speed $V_{INPUT}$ to the transport speed $V_{TR}$ with the aid of the step motor SM1A.

If the single sheet is transported until the light barrier LS5, this detects the arrival time of the single sheet and in turn compares the arrival time with a second desired point in time. Given agreement of the arrival point in time with the desired point in time, the drive speed of the roller pair WP5 driven by the step motor SM1A is (dependent on the comparison result) held to transport speed $V_{TR}$, accelerated to a speed greater than $V_{TR}$ for a time span or reduced to a speed smaller than $V_{TR}$ for a time span. After this time span with increased or reduced speed, the single sheet is transported further with transport speed $V_{TR}$. The single sheet is subsequently supplied to the roller pair WP6 driven by the step motor SM9 and to the roller pair WP7 driven by the step motor SM2A, transported by these with transport speed $V_{TR}$ and monitored by the light barrier LS6, LS7 arranged in front of the respective roller pair WP6, WP7. This monitoring serves in particular for detection of paper run errors such as, for example, paper jams. The single sheet is supplied by the roller pair WP7 to the light barrier LS9 and is forwarded by the roller pair WP9 to the printer (not shown) in the direction of the arrow P2.

As already mentioned, a stack of single sheets is also contained in the reservoir tray Tray_B. In the same manner as described in connection with reservoir tray Tray_A, the single sheet is extracted and accelerated to the feed speed $V_{INPUT}$ with the aid of the suction belt SB_B that is driven by the step motor SM2B. The roller pair WP2 driven by the step motor SM2A forwards the single sheet at the speed $V_{INPUT}$, whereby the arrival point in time of the single sheet at the light barrier LS2 downstream from the roller pair WP2 is detected and compared with a desired point in time previously established by a main controller for this light barrier LS2 and the single sheet. Dependent on the comparison result, the point in time is established at which the transport speed of the single sheet is reduced from the feed speed $V_{INPUT}$ to the transport speed $V_{TR}$. The speed reduction is implemented by a revolution speed change of the step motor SM2A. The drive speed of the roller pair WP7 is thereby simultaneously reduced to the speed $V_{TR}$.

The arrival point in time of the single sheet extracted from the reservoir tray Tray_B is detected with the aid of the light barrier LS7 and compared with a further desired point in time previously established for the light barrier LS7 and the single sheet. Dependent on the comparison result, the transport speed $V_{TR}$ of the single sheet is maintained, the transport speed is increased for a determined time span or the transport speed is reduced for a determined time span. A time-dependent regulation of the transport position of the extracted single sheet thus occurs for the single sheet extracted from the reservoir tray Tray_B with the aid of the roller pair WP2 and of the roller pair WP7 as well as with the aid of the light barriers LS2 and LS7, such that said single sheet arrives at the light barrier LS9, which is designed as a transfer light barrier to the printer, at a predetermined desired point in time.

Dependent on the material properties of the respective single sheet, a slip primarily occurs in the extraction of single sheets from the reservoir tray Tray_A, Tray_B, Tray_C, Tray_D. It is thereby not ensured that single sheets extracted in succession from the same reservoir tray Tray_A require the same time up to the transfer light barrier LS9. However, it can be assumed that no slippage or a constant slippage always occurs from the first roller pair after the respective reservoir tray Tray_A, Tray_B, Tray_C, Tray_D, i.e. after the roller pair WP1 at the reservoir tray Tray_A and after the roller pair WP2 at the reservoir tray Tray_B on the path up to the light barrier LS9. The position differences of successive single sheets occurring in the extraction from the reservoir tray Tray_A, Tray_B is compensated by the regulation of the feed speed already described, such that successive single sheets successively arrive at the light barrier LS9 in a preset temporal sequence, whereby an exact sheet separation between successive single sheets is generated dependent on the constant transport speed $V_{TR}$. This is also possible in a simple manner via the feeder unit of the preferred embodiment when the successive single sheets are extracted from different reservoir trays and/or have different paper format.

As already described in connection with the reservoir trays Tray_A and Tray_B, the uppermost single sheet of the reservoir tray Tray_C is extracted from this with the help of a suction belt SB_C and accelerated to a feed speed $V_{INPUT}$. The suction belt SB_C is driven with the aid of a step motor SM3B. The arrival time at the light barrier LS3 is compared with a desired point in time previously determined by a control unit of the feeder unit. Dependent on the comparison result, the control unit determines the point in time at which the roller pair WP3 reduces the feed speed $V_{INPUT}$ to the transport speed $V_{TR}$. It is thereby achieved that the single sheet extracted from the reservoir tray Tray_C arrives at the light barrier LS9 at a predetermined desired point in time. However, in contrast to the reservoir tray Tray_B and the reservoir tray Tray_A, no regulation occurs in the extraction of the single sheet from the reservoir tray Tray_C, since only a desired point in time is recorded with the aid of the light barrier LS3 and not with two light barriers respectively arranged along the transport path at an interval, as this occurs with the reservoir trays Tray_A and Tray_B. However, if a deviation from the preset desired point in time is established in the comparison of the arrival point of time of the single sheet extracted from the reservoir tray Tray_C at the light barrier LS9, for subsequent single sheets extracted from the feed tray Tray_C the point in time for reduction of the feed speed $V_{INPUT}$ to transport speed $V_{TR}$ by the roller pair WP3 is changed such that these subsequent single sheets extracted from the reservoir tray Tray_C then arrive at the light barrier LS9 at the point in time predetermined for these sheets. This can, for example, occur via an offset value and/or via a correction factor. A superior regulation thus occurs for subsequent single sheets.

The uppermost single sheet arranged in the reservoir tray Tray_D is accelerated to feed speed $V_{INPUT}$ with the aid of the suction belt SB_D and supplied to the roller pair WP4. The roller pair WP4 is and suction belt SB_D are driven with the aid of the step motor SM4A and SM4B respectively. The arrival time of the single sheet extracted from the reservoir tray Tray_D is detected at the light barrier LS4 and, as already described in connection with the reservoir tray Tray_C, the point in time at which the feed speed $V_{INPUT}$ is reduced to the transport speed $V_{TR}$ with the aid of the roller pair WP4 is established dependent on the comparison result of the arrival point in time with a predetermined desired point in time. The single sheet extracted from the reservoir tray Tray_D is subsequently supplied to the light barrier LS8 that monitors the correct paper path. The single sheet is subsequently forwarded by the roller pair WP8 up to the light barrier LS9. The roller pair WP8 is driven by the step motor SM9, whereby the single sheet is conveyed on the paper path to the printer with the constant transport speed $V_{TR}$.

The single sheets supplied in the arrow direction of the arrow P1 can also be supplied by an external pre-processing unit such as, for example, a further printer, a stamping unit or a cutting unit. In general it can be said that the single sheets extracted from the reservoir trays Tray_A, Tray_B, Tray_C, Tray_D are positioned with the aid of the step motors SM1A, SM2A, SM3A and SM4A, such that they respectively arrive at the light barrier LS9 at a preset arrival point in time. This positioning occurs dependent on previously-established desired points in time at light barriers that are used for control or for regulation of the single sheet adjustment. These light barriers determine the real point of time that is then compared with a previously-established desired point in time.

Dependent on the comparison result, the point in time is then determined at which the feed speed $V_{INPUT}$ is reduced to transport speed $V_{TR}$. The point in time at which a predetermined sheet edge (for example the leading sheet edge in the transport direction) of the single sheet is used as an arrival point in time. In that no slippage or only a very slight slippage occurs after the roller pair downstream from the respect reservoir tray until the transfer of the single sheet to the printer in the direction of the arrow P2, only the position deviations that occur in the extraction of the single sheet from the respective reservoir tray must be taken into account in the sheet adjustment in the feeder unit. This sheet adjustment of the preferred embodiment enables further desired points in time of the single sheet to also be exactly established in the subsequently-arranged printer and to be used for the entire printer control, since the transport points in time of the single sheets to the printer are very exactly maintained by the feeder unit 10. The paper paths of different lengths of the single sheets from the different reservoir trays Tray_A, Tray_B, Tray_C, Tray_D to the light barrier LS9 are taken into account in the determination of the desired points in time. The sheet separations are controlled and regulated with high precision with the aid of the desired points in time via the exact arrival points in time of successive single sheets.

Figure 2:
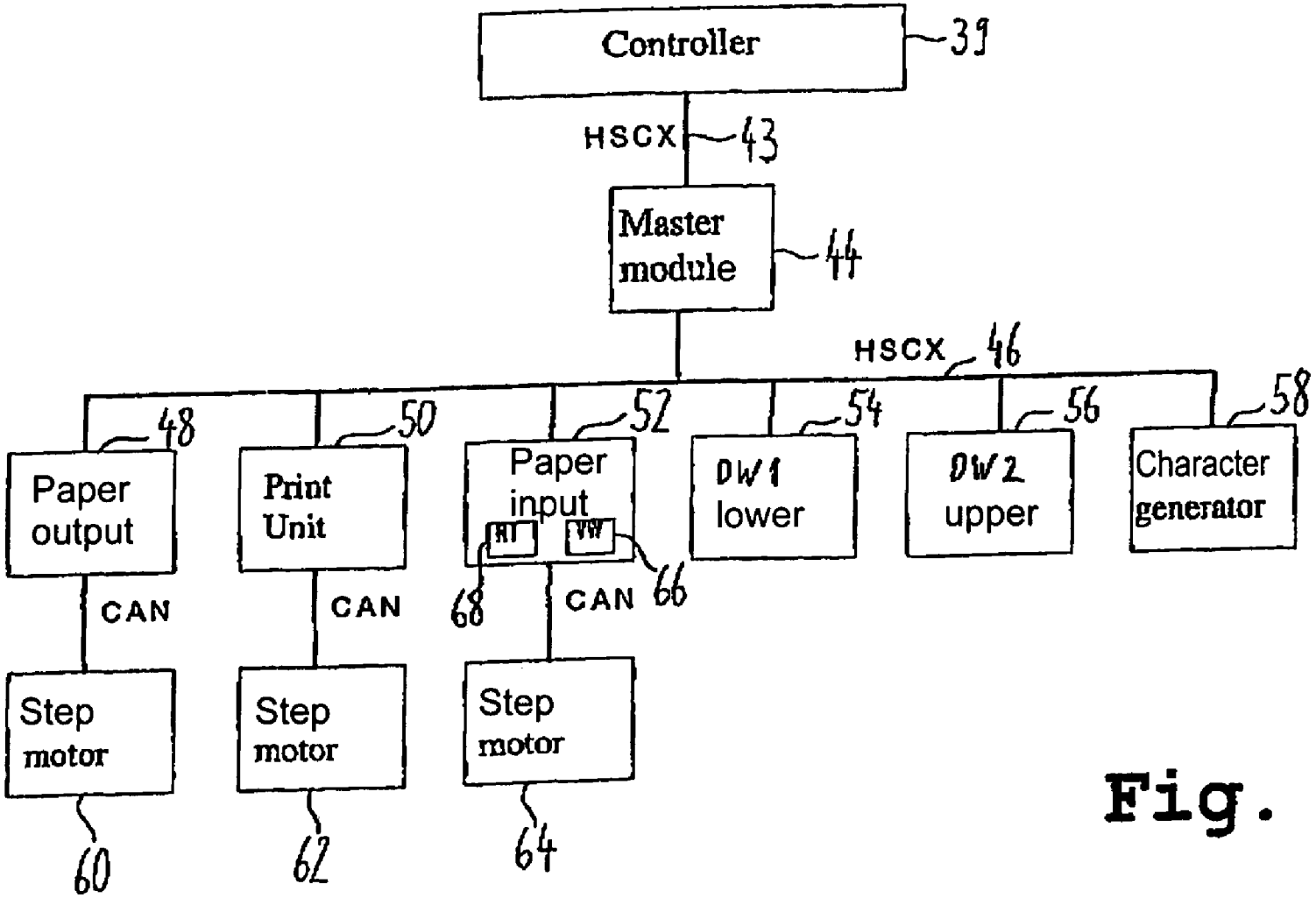
FIG. 2 is a block diagram of a printer controller.

FIG. 2 shows a block diagram with control units of the printer. Single-sheet-related information is determined from a print data stream with the aid of a controller 39. The same elements have the same reference characters. This single-sheet-related information is transferred to a main controller 44 with the aid of an HSCX bus 43. This information contains what is known as the side applications for sides to be printed and single sheets to be printed. The main controller 44 translates this information into control data. The main controller 44 supplies these control data to subordinate controllers 48 through 58 with the aid of a second HSCX bus system 46. The subordinate controllers 48 through 58 respectively have a time control unit with a 32-bit counter as a timer, whereby all time control units of the printer are synchronized and are clocked with the aid of the same clock signal. The clock signal is generated by the main controller 44 and transferred to the timers of the control units 48 through 58 via a clock signal line.

The control data that are generated by the main controller 44 for the subordinate controllers 48 through 58 contain the side number of the side to be printed, the paper format (especially the paper length and the paper width), the toner reservoir Tray_A through Tray_D from which the single sheet to be printed is extracted and the stacking tray in which the printed single sheet is deposited, the operating mode in which the single sheet is printed and a minimum sheet separation from a subsequently single sheet to be printed. The minimum separation from the next single sheet to be printed is established dependent on the operating mode in which the current single sheet is printed or should be printed.

For example, provided in a printer with two printing groups are the operating modes: fast simplex, in which a first single sheet is supplied on a first transport path to the first printing group for printing of the front side and a second single sheet is supplied on a second transport path to a second printing group for printing of the front side; a duplex operating mode, in which a single sheet is supplied to the first printing group for printing on the front side and subsequently to the second printing group for printing of the back side; a highlight-color operating mode in which the first printing group prints a print image in a first color on the front side of the single sheet and the second printing group subsequently prints a second print image in a second color on the front side; as well as a highlight-color duplex operating mode, in which one print image is respectively generated on the front side and on the back side in the first color with the aid of the first printing group and a second print image is generated in a second color by the second printing group.

From the control data transferred from the main controller 44, with the aid of an administration component contained in the respective control unit 48 through 58 the respective control unit 48 through 58 determines desired points in time that refer to a system time of the printer that is formed with the aid of a timer of a real-time component of the respective control unit 48 through 58. The real-time component of the control unit 52 is designated with 68 and the administration component of the control unit 52 is designated with 66. The real-time component 68 is a time control unit for monitoring of desired points in time. The desired points in time are established such that the least possible sheet separations between successive single sheets to be printed are set for the operating mode, whereby a highest possible printing speed is achieved. As already described for FIG. 1, the desired points in time comprise action points in time for valves, for belt drives and roller drives, desired points in time for arrival points in time of a sheet edge at the light barriers as well as desired points in time for further sensors. The synchronization of the timers of the control units 44, 48 through 50 is initiated by the main controller 44. The timers contain a 32-bit counter, whereby all counters count the clock pulses of the same clock signal of 100 kHz that is generated by the main controller 44.

A count value of the counters is determined at the desired point in time at which the activation of an actuator should occur and/or at which a sensor signal is expected. From the control data of the main control 44, with the aid of one of the administration components, the control unit 48 determines desired points in time that concern the paper output control. An administration component of the control unit 50 determines desired points that concern the paper input; an administration component of the control unit 54 determines desired points in time of the printing group DW1; an administration group of the control unit 56 determines desired points in time that concern the printing group DW2; and an administration group of the control unit 58 determines desired points in time that concern the character generator. The control units 48 through 58 are connected with sensors (not shown) such as, for example, LS1 through LS13, S1 through S13 as well as with actuators SM1A, SM1B through SM9 that are evaluated or, respectively, activated by the control units 48 through 58. The step motors SM1A, SM1B through SM9 are activated via step motor activation units 60, 62, 64 that are connected with the respective controller 48, 50, 52 with the aid of a CAN bus system.

Figure 3:
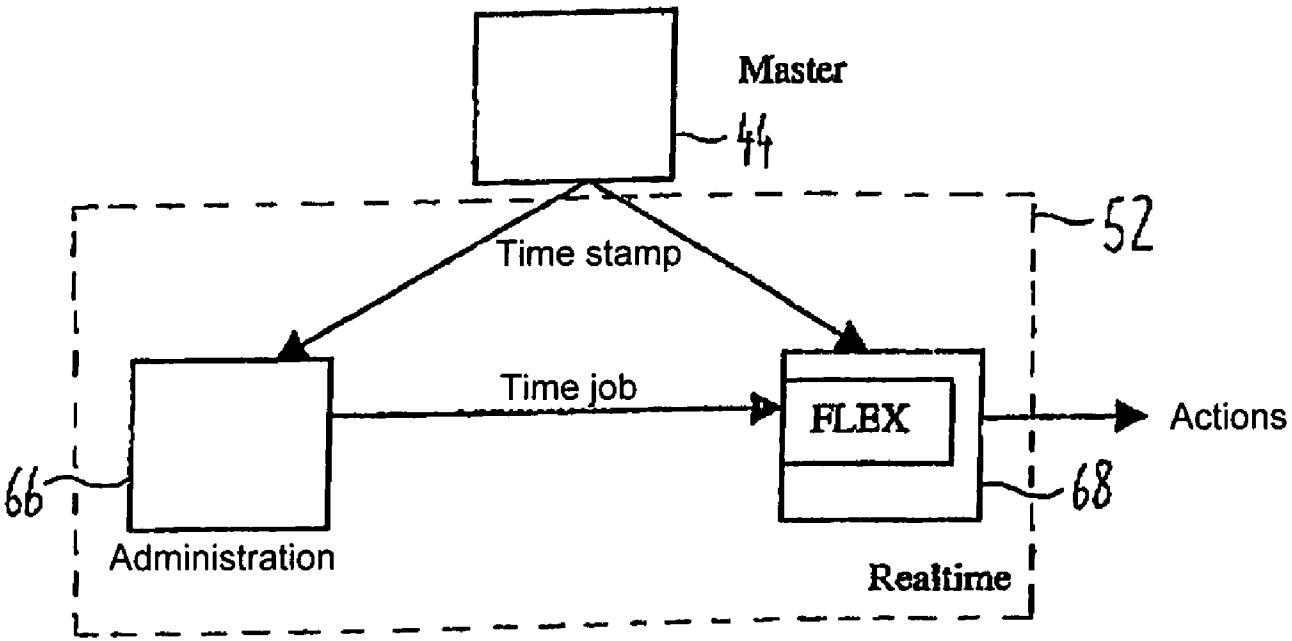
FIG. 3 is a block diagram for establishment and monitoring of desired points in time for control of the printing workflow in the printer.

A block diagram with an arrangement for monitoring of desired points in time and establishment of control points in time for actuators is shown in FIG. 3. The main controller 44 transmits a clock signal of 100 kHz as well as control data to the administration component 66 of the paper input control unit 52. As already described, the administration component 66 determines the desired points in time as 32-bit count values. These count values relate to the count value of the timer of the real-time component 68. In addition to the respective count value, specifications about the control event to be executed upon reaching the count value are determined in the administration component 66. If a desired point in time concerns a step motor activation unit 64 connected with the control unit, a desired point in time is transferred to this step motor activation unit 64 and monitored by a time control unit of the step motor activation unit 64. This time control unit is likewise supplied the clock signal of the main controller 44.

The desired points in time are preferably administered with the aid of a storage administration (not shown) such that they are sorted in the administration component 66 according to the temporal sequence of the desired points in time. The temporal desired point in time reached next is transferred to a time control unit 68 together with the associated control information. The time control unit 68 compares the desired point in time with the current time, in that it compares the count value of the desired point in time with the real value of the counter of the timer. If the time value of the timer reaches the value of the desired point in time or if it exceeds this, an interrupt is triggered by the time controller 68 and an interrupt service routine is invoked.

A preset interrupt is selected corresponding to the control information with the aid of what is known as a flex component (PLD component) contained in the real-time component 68. The control unit 52 implements the provided control action of the actuators or the monitoring of the sensors with the interrupt service routing invoked by the selected interrupt. The control unit 52 is unloaded of the monitoring of the desired points in time via the separate monitoring of the desired points in time with the aid of the time control unit 68. Via the interrupt-controlled invocation of the control action, it is achieved that the control event is implemented by the control unit 52 immediately after the desired point in time is reached, for example with the aid of an evaluation and activation unit (not shown) of the control unit 52 that monitors light barriers and controls valves. The single sheet transport through the printer as well as the control of the print process are thereby also possible with very high precision with high process speeds in high-capacity printers. In particular in high-capacity printers with a printing speed of greater than 150 sheet A4 per minute, such a high-precision page positioning is necessary in order to be able to generate exact print images. The performance of the printing system can be significantly increased via adherence to exact minimal sheet separations between subsequent single sheets.

Figure 4:
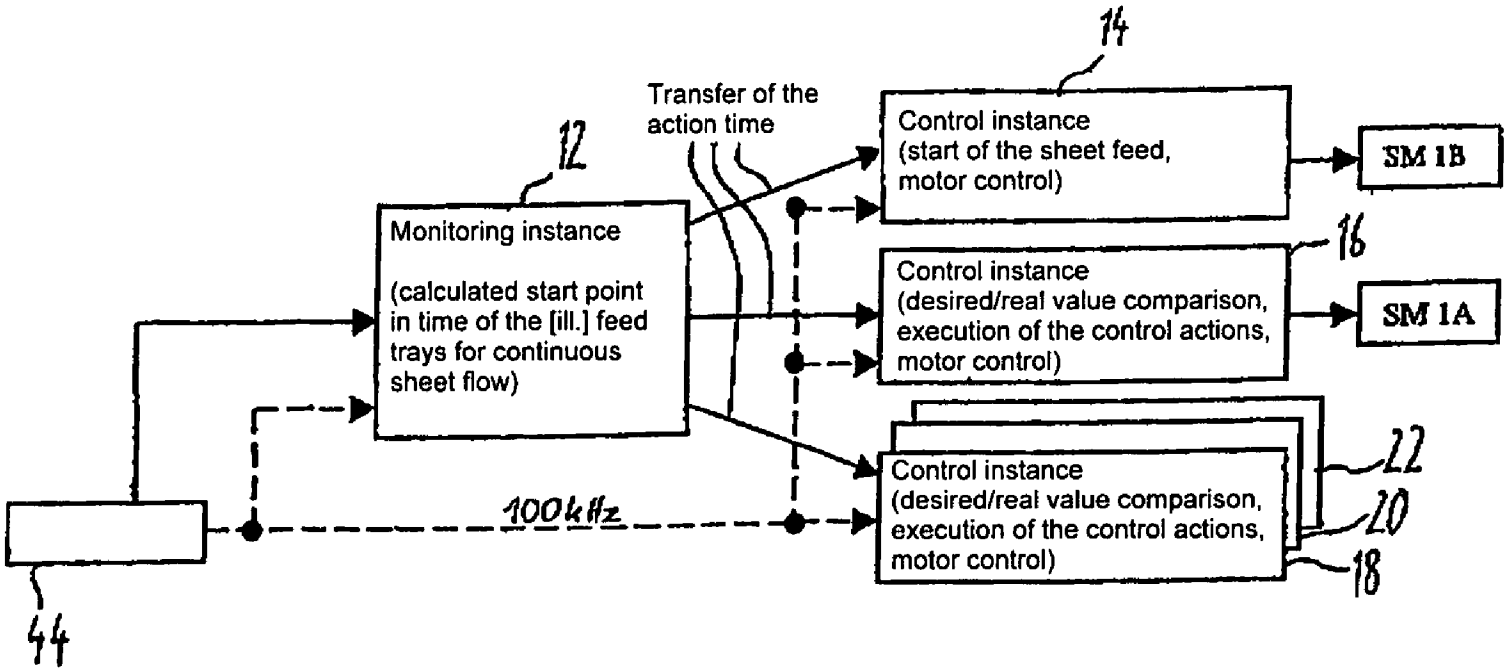
FIG. 4 is a block diagram of a controller for control of the step motors of reservoir trays of the feeder unit according to FIG. 1.

A block diagram with elements for the control of the step motors for extraction of a single sheet respectively from the reservoir trays Tray_A through Tray_D is shown in FIG. 4. Each reservoir tray comprises two step motors, whereby a separate instance is provided for activation of each step motor. A control instance 14 is provided for activation of the step motor SM1B of the reservoir tray A and a control instance 16 is provided for activation of the step motor SM1A. A control instance 18 is provided for activation of the step motors of the reservoir tray Tray_B, the control instance 20 is provided for activation of the step motors of the reservoir Tray_C and the control instance 22 is provided for activation of the step motors of the reservoir tray Tray_D. A monitoring instance 12 is also provided that determines the control points in time for activation of the step motors SM1A, SM1B for the reservoir tray Tray_A as well as control points in time for the step motors of the further reservoir trays from control data that are supplied to the monitoring instance 12 from the main module 44.

The monitoring instance 12 is, for example, supplied as an administration component 66 to the control unit 52 according to FIG. 52. The monitoring instance 12, the control instance 14, the control instance 16 as well as the control instances 18, 20, 22 respectively contain a time control unit which is supplied a clock signal of 100 kHz generated by the main controller 44. As already described in connection with FIGS. 1 through 3, the time control units contain a 32-bit counter, whereby the count values of the 32-bit counters of the time control units are synchronized by the main controller 44 such that all counters have the same count value as the timer. As already mentioned, the monitoring instance 12 determines from the control data control points in time of the step motors to be activated and transfers these to the control instances 14, 16, 18, 20, 22 as a 32-bit desired value.

The control instances 14 through 22 monitor the respective transmitted desired points in time and execute a control action upon reaching the desired point in time. With the help of the desired points in time, a step motor is, for example, activated, deactivated or a ramping function to change the speed is started. The control instances 14 through 22 are, for example, executed as a step motor controller 64 according to FIG. 2. The control instance 14 activates the step motor SM1B and monitors a start time for the sheet feed. The control instance 16 accelerates the fed single sheet to feed speed $V_{INPUT}$ and, with the aid of time differences, a point in time it is begun to reduce the feed speed $V_{INPUT}$ to transport speed $V_{TR}$ according to a ramp function. The control instance 16 then starts at this point in time, whereby the feed speed of the single sheet is uniformly reduced to transport speed. The control instances 14 and 16 furthermore monitor the start points in time of the respective step motors SM1B, SM1A.

The instances, such as the monitoring instance 12, the control instances 14 through 22 as well as further control, regulation and feed instances, can, for example, be executed as separate processes by a control unit of the printer or copier, for example in multitasking operation in multiprocessor operation. The same program parts that are invoked and executed in parallel by a superordinate program with different parameters are preferably used at least in part for the control instances 14 through 22.

Figure 5:
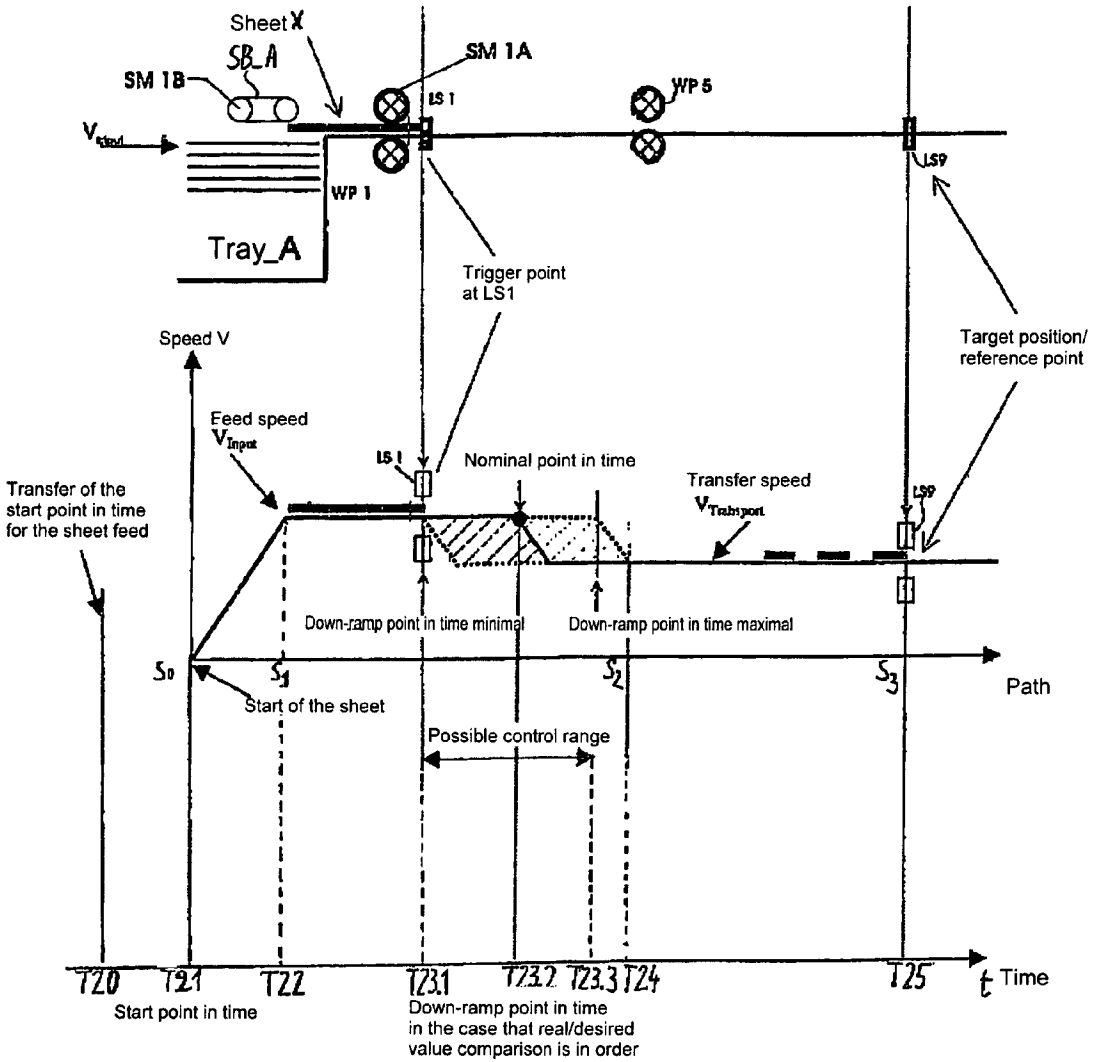
FIG. 5 is a workflow diagram in which is shown the control of the feed of a single sheet with the aid of the feeder unit according to FIG. 1.

A diagram for control of the sheet feed of a single sheet X from the reservoir tray Tray_A is shown in FIG. 5. At the point in time T20, the monitoring instance 12 transmits the start point in time to the control instance 14 as a 32-bit count value for feed of a single sheet X from the reservoir tray Tray_A. The control instance 14 continuously compares the start point in time T21 transmitted as a count value with the current count value of the timer. The control instance 14 starts the step motor SM1B for operation of the suction belt SB_A such that the uppermost sheets in the reservoir tray Tray_A is uniformly accelerated up to feed speed $V_{INPUT}$.

The feed speed $V_{INPUT}$ is reached at the point in time T22. The control instance 16 activates the step motor SM1A to drive the roller pair WP1. The suction belt SB_A supplies the single sheet X at the feed speed $V_{INPUT}$ to the main roller pair WP1, which forwards the single sheet X with the feed speed $V_{INPUT}$.

The leading edge of the single sheet X reaches the light barrier LS1 at the point in time T23.1. This arrival point in time T23.1 is detected and compared with a desired point in time previously transmitted to the control instance 16 by the monitoring instance 12. If the arrival point in time T23.1 coincides with the desired point in time, the feed speed $V_{INPUT}$ is maintained by the roller pair WP1 up to the point in time T23.2 (nominal point in time) at which the speed is uniformly reduced to the transport sped $V_{TR}$. If the arrival point in time T23.1 of the single sheet X at the light barrier LS1 is smaller than the desired point in time, i.e. the leading edge of the single sheet X arrives at the light barrier LS1 too early, a point in time before the point in time T23.2 at which the feed speed $V_{INPUT}$ is reduced to transport speed $V_{TR}$ is established dependent on the amount of the deviation. At the earliest this point in time can be the point in time T23.1. However, if the leading edge of the single sheet X arrives at the light barrier LS1 after the predetermined desired point in time T23.2, a point in time is determined for reduction of the feed speed $V_{INPUT}$ to transport speed $V_{TR}$ that lies after the desired point in time T23.2. The point in time for reduction of the feed speed $V_{INPUT}$ to transport speed $V_{TR}$ is also designated as a down-ramp point in time. The latest possible down-ramp point in time is the point in time T23.3, whereby then the uniform reduction of the feed speed $V_{INPUT}$ to transport speed $V_{TR}$ is concluded at the point in time T23 at which the leading edge of the single sheet X reaches the roller pair WP5.

As already described in connection with FIG. 1, the arrival time of the single sheet X at the light barrier LS5 is detected and compared with a further desired point in time. If a deviation of the arrival point in time from the desired point in time exists, a further correction is achieved via a temporary speed change of the transport speed of the single sheet X with the aid of the roller pair WP5, such that the single sheet X subsequently arrives at the light barrier LS9 at a predetermined point in time. Due to the exactly controlled or regulated arrival time of the single sheet at the light barrier LS9, a predetermined separation between the successive single sheets results for successive single sheets due to the constant transport speed $V_{TR}$ and the temporally-offset arrival of the single sheets at the light barrier LS9. This separation is also designated as a sheet separation or a gap. Such a position control of the single sheet controlled with the aid of desired points in time is high-precision and can also be implemented at other locations of the printer, for example before a printing group or before output of the print pages from the printer. The possible adjustment region thus corresponds to the span of time between the point in time T23.1 and the point in time T23.3. In other exemplary embodiments, the point in time T23.3 is not located in the middle of the adjustment range, but rather is asymmetrically shifted in the adjustment range, preferably in the direction of the point in time T23.1.

The uniform acceleration of the single sheet X to the feed speed $V_{INPUT}$ is also designated as a ramp acceleration. The uniform reduction of the feed speed $V_{INPUT}$ to the transport speed $V_{TR}$ likewise occurs in the form of a ramping. Due to the preset accelerations and speeds, the single sheet X has covered a section S1 at the point in time T22, a section S2 at the point in time T24 and a section S3 at the point in time T25.

In other exemplary embodiments, the roller pair WP5 is also driven by the step motor SM9 with the constant transport speed $V_{TR}$, whereby then a position correction of the fed single sheet X only occurs with the aid of the roller pair WP1 and thus only a control of the position of the single sheet X occurs. However, the arrival point in time of the single sheet X at the light barrier LS9 is detected and compared with a desired point in time established for the single sheet X. If a deviation of the arrival point in time from the desired point in time is present, a correction value is determined for subsequent single sheets to be fed from the reservoir tray Tray_A, which correction value is then used to determine the point in time for reduction of the feed speed $V_{INPUT}$ to transport speed $V_{TR}$. This correction value can, for example, be what is known as an offset value or a correction factor.

Figure 6:
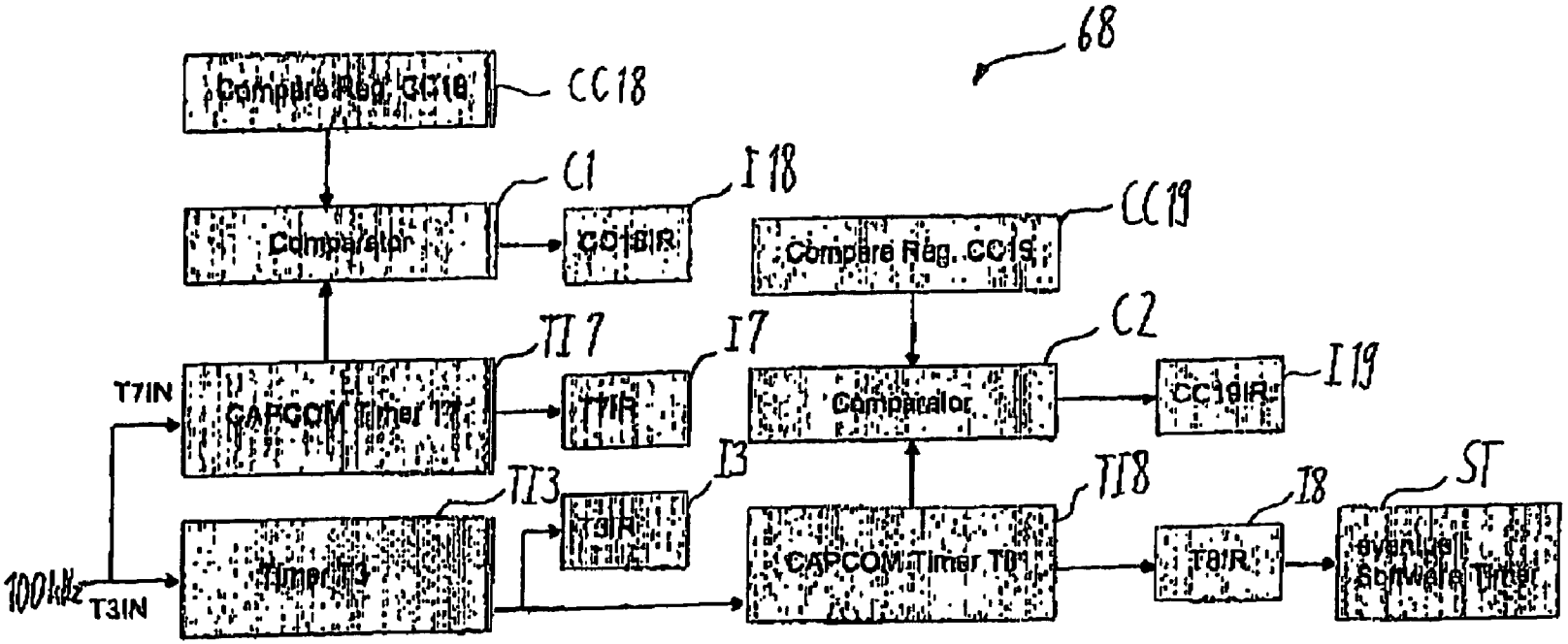
FIG. 6 is a schematic design of a time control unit.

FIG. 6 shows the schematic design of a time control unit 68 as it is also used in the control instances 14 through 22. Time control units identical in construction are used in further control units and assemblies of the printer, whereby one time control unit can also be associated with a plurality of instances and/or control units.

The time control unit 68 serves to monitor desired points in time at which actions in the printer should be started, such as, for example, upon feed of a single sheet or upon changing the transport speed. The time control unit 68 contains timers with two cascaded 16-bit counters T3 and T8. A 32-bit timer for monitoring of desired values 32-bits in size is formed with the aid of the counters T3 and T8. A central clock signal of a clock pulse generator of the printer is supplied by the counter T3 with a clock frequency of 100 kHz. With an initial clock frequency of 100 kHz, desired points in time within a time span of 11.93 hours can thus be continuously monitored with high-precision with the aid of the time controller according to FIG. 6.

Upon overflow of the 16-bit counter T3, an interrupt signal I3 is output, and upon overflow of the 16-bit counter T8 an interrupt signal I8 is output, which signals can be used for further control purposes. To monitor a desired point in time beyond the 11.93 hours, a counter formed as software by the time control unit 68 is counted further with the aid of the interrupt I8. The low-order 16-bit of a 32-bit desired value are stored in the job storage CC18 and the upper 16-bit of the 32-bit desired value are stored in the storage CC19.

A comparator C1 compares the 16-bit value stored in the storage CC18 with the current count value of a timer T7. The clock signal of 100 kHz of the central clock pulse generator of the printer is likewise supplied to the timer T7. Upon reaching and/or exceeding the low-order 16-bit part of the 32-bit desired value, the comparator C1 outputs an interrupt signal T18 via the current count value of the counter T7. The comparator C2 continuously compares the upper 16-bit value (stored in the storage CC19) of the 32-bit desired value with the current count value of the counter T8. The comparator C2 outputs interrupt signal T19 given agreement or excess of the desired point in time stored in the storage CC19. If the count values of the counter T7 and T8 respectively agree with the desired values stored in the storages CC18 and CC19, the desired point in time has been reached. A provided control action is executed by a control unit of the printer, for example via an interrupt of the time control unit 68 according to FIG. 6. The time control unit 68 according to FIG. 6 can, for example, be very simply realized with the aid of what is known as the capture/compare unit of the 16-bit microprocessors C164CI and C167CR by the firm Infineon.

If, for example, the point in time for reduction of the feed speed $V_{INPUT}$ to transport speed $V_{TR}$ should be monitored, this point in time is written into the storages CC18 and CC19 as a 32-bit value. Upon reaching the desired point in time for reduction of the feed speed $V_{INPUT}$ to transport speed $V_{TR}$, an interrupt signal I18 is output by the comparator C1 and an interrupt signal I19 is output by the comparator C2. Corresponding control events to reduce the speed are controlled by the control units of the printer based on both of these interrupt signals I18, I19. A program routing in the printer is preferably provided that, in a preset operating state of the printer, resets the current count values of all time control units 68 and starts these again at the same point in time.

Figure 7:
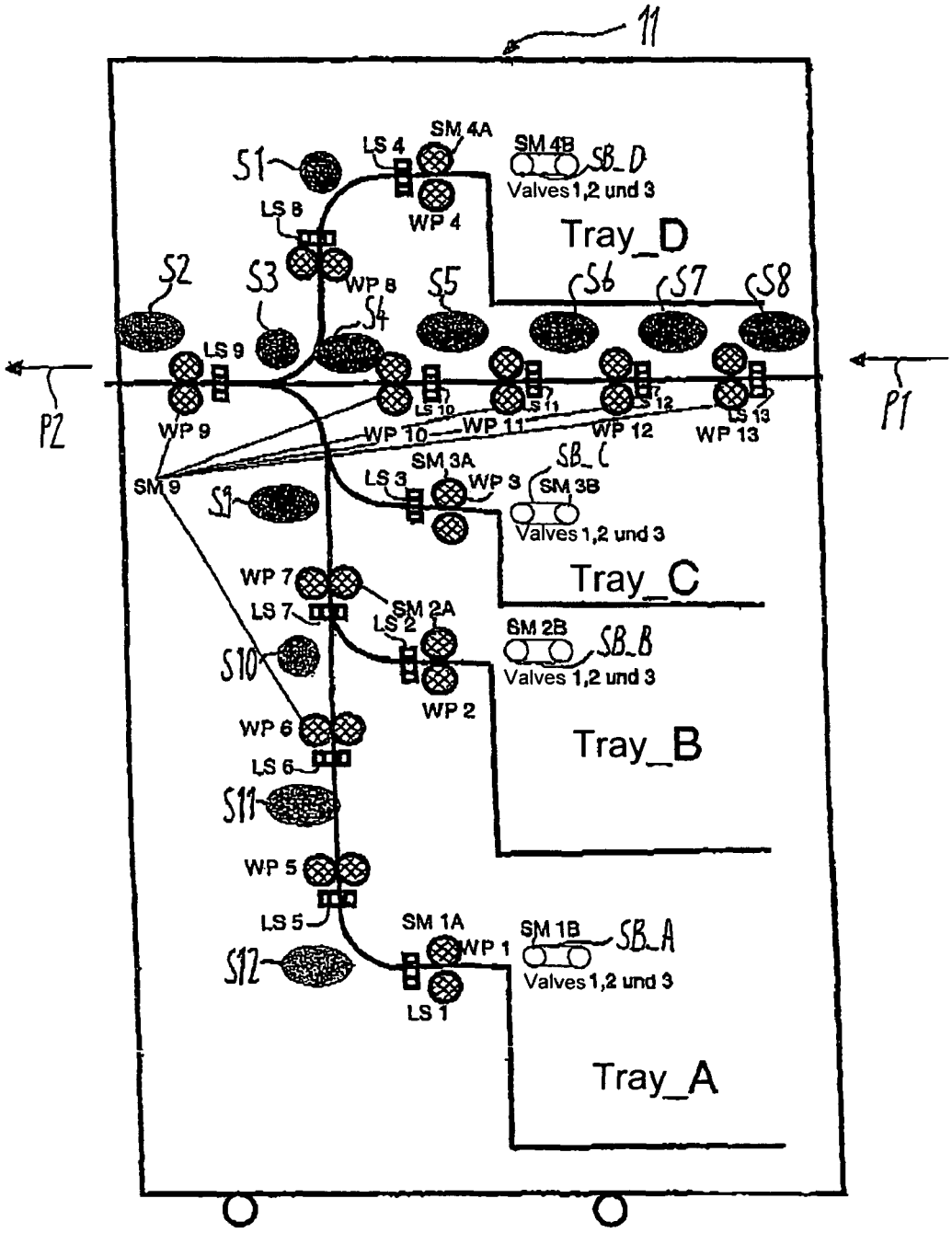
FIG. 7 shows the schematic design of the feeder unit according to FIG. 1, whereby air vanes of the feeder unit are shown.

FIG. 7 shows a feeder unit 11 that, in addition to the elements of the feed unit according to FIG. 1, shows sensors for position monitoring of housing parts of the feeder unit 11 to be opened. Such housing parts are, for example, what are known as air vanes of the feeder unit 11 that can be opened to extract single sheets as a result of a paper jam or for maintenance tasks. The position sensors are, for example, end switches that monitor the closed state of these housing parts, for example these air vanes. The position monitoring sensors are designated with S1 through S12 in FIG. 7. However, the feeder unit 11 has further air vanes whose position is not monitored with the aid of sensors. These air vanes not monitored with sensors are mechanically secured with the monitored air vanes such that they are only to be opened after opening of a monitored air vane.

Figure 8:
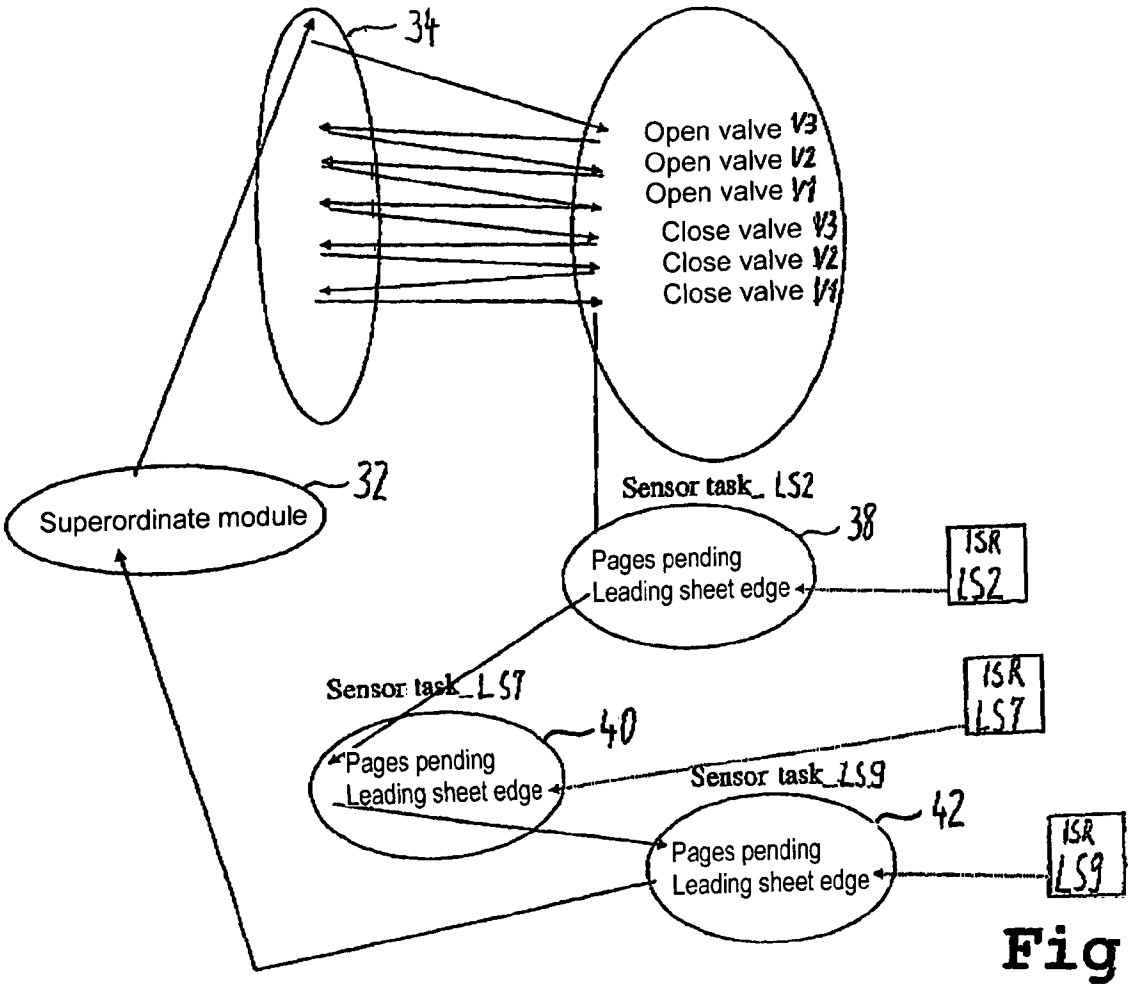
FIG. 8 is a block diagram for control of a feeder unit with the aid of a plurality of processes.

FIG. 8 shows a plurality of processes for control of the feeder unit 11 according to FIG. 7. These processes, which are also designated as tasks in FIG. 8, are executed by a controller in parallel or in a multitasking operation. The individual processes, i.e. the individual tasks, are executed independent of one another. The operating system or the firmware of the controller controls the parallel execution of the processes and the simultaneous execution of the processes in multitasking or multiprocessor operation.

In the multitasking operation, the simultaneity refers to an execution strategy in which processing capacity of the processor is respectively allocated among the jobs for a short time. This short time is also designated as a timeslot or timeslice. For a plurality of processes, it thus has the appearance as if these processes are being executed simultaneously by the controller. For example, the operating system PXROS by the firm HIGHTEC can be used for execution of a plurality of parallel processes, that also enables a program to be started in different tasks with varying parameters. The same program can be started thirteen times in different tasks to monitor the light barriers LS1 through LS13, whereby these thirteen tasks and further tasks are executed in parallel.

A superordinate module 32 determines information from the print data stream that concern a single sheet X to be printed and establishes desired point in times for control of the single sheet. This superordinate module 32 can, for example, be executed as a monitoring module 12 according to FIG. 4 or as an administration component 66 according to FIG. 2. The superordinate module 32 transfers to the time process 34 the values of all desired points in time that concern the valves V1 through V3 and the light barriers LS2, LS7 and LS9. The values of the desired points in time are related to the current time value of a timer. A plurality of timers are preferably provided in the printer (whereby each control unit has its own timer) that are synchronized with the aid of a synchronization event and that are activated by a uniform clock signal. These timers are preferably executed as 32-bit counters that are clocked with a clock of 100 kHz. The count value of the counter of the timer thus forms the time normal of the printer to which all desired points in time and real points in time correspond. The desired points in time are established via determination of a count value of the counter. Upon occurrence of an event, for example upon arrival of a sheet edge at a light barrier, the light barrier outputs a sensor signal. The current counter state of the timer is detected as an arrival point in time or as a real point in time and (as already described further above) compared with the established desired point in time.

The desired points in time transferred to the time process 34 contain control points in time for control of the valves V1, V2 and V3 for extraction of the single sheet C from the reservoir tray Tray_B as well as points in time for monitoring of the paper path of the single sheet X up to the light barrier LS9 with the aid of the light barriers LS2, LS7 and LS9. The desired points in time are transferred to the time process 34 with the aid of a message.

Given an opened valve, the valve V3 supplies air to a side nozzle via which the uppermost single sheet X is detached from the remaining paper stack located in the toner reservoir Tray_B. The valve V2 supplies air to a front nozzle through which the single sheets in the toner reservoir Tray_B below the single sheet X in the reservoir tray Tray_B are held back. With the aid of the valve V1, the suction chamber of the suction belt SB_B is supplied vacuum air via which the single sheet X is lifted from the paper stack in the toner reservoir Tray_B and adhered to the suction belt SB_B. A valve process is provided to activate the valves V1, V2, V3 of the toner reservoir Tray_B. The time process 34 and the valve process 36 are preferably executed by the same control unit or data processing system.

With the help of a message, the time process 34 transfers to the valve process 36 all desired points in time established by the superordinate module 32 for the valves V1, V2, V3 and for the light barriers LS1, LS7, LS9. A message function for transfer of the message is preferably provided by an operating system or a firmware of the control unit or data processing system, via which the timer process 34, the valve process 36 as well as the sensor processes 38, 40, 42 are executed. From the transferred desired points in time, the valve process 36 determines the desired point in time of the next action to be executed and sends a message with all desired points in time back to the time process 34, whereby the desired point in time of the next action to be executed is identified. The time process 34 determines the identified desired point in time and transfers this desired point in time to a time control unit (not shown). This time control unit is preferably contained in a flex component of a real-time assembly.

Upon reaching this desired point in time, the time control unit executes an interrupt via which a message with the desired points in time and information about reaching the desired point in time to open the valve V3 is transmitted to the time process 34. The valve process 36 thereupon activates the valve V3 for opening. All remaining desired points in time are subsequently transferred from the valve process 36 to the time process 34 with the aid of a message, whereby the desired point in time is identified that is associated with an action to be executed next. The time process 34 transfers to the time control unit a desired count value that corresponds to the desired point in time. After reaching the desired point in time, the time control unit generates an interrupt. The time process 34 generates a message for the valve process based on the interrupt and transfers to the valve process all still-current desired points in time as well as the information that the point in time to open the valve V2 has been reached. The valve process thereupon opens the valve V2 and sends a next message with all currently-remaining desired points in time to the time process 34, whereby a desired point in time for opening of the valve V1 is identified.

The point in time for opening of the valve V1 is transmitted by the time process 34 to the time control unit, which initiates an interrupt after reaching the desired point in time. The time process 34 generates a message for opening of the valve V1 based on the interrupt and transfers this message to the valve process together with the further desired points in time. The valve process opens the valve V1. The valve process subsequently transfers the remaining desired points in time to the time process 34 with the aid of a message, whereby the desired point in time for closing of the valve V3 is identified.

The time process 34 transfers the desired point in time for closing of the valve V3 to the time control unit. Upon reaching the desired point in time, the time control unit initiates an interrupt, whereby the time process 34 transfers to the valve process V3 a message with the remaining desired points in time and information for closing of the valve V3. The valve process closes the valve V3. The valve process subsequently generates a message with the remaining desired points in time, whereby the remaining point in time for closing of the valve V2 is identified. The time process 34 transfers the identified desired point in time to the time control unit, which initiates an interrupt after reaching the desired point in time. Based on the interrupt, the time process 34 generates a message with the remaining desired points in time and the information for closing of the valve V2 for the valve process.

The valve process closes the valve V2 and generates a message with the remaining desired points in time and transfers this message to the time process, whereby the desired point in time for closing of the valve V1 is identified. The time process 34 transfers the desired point in time for closing of the valve V1 to the time control unit, which outputs an interrupt signal to the time process 34 after reaching the point in time. Based on the interrupt, the time process 34 generates a message with the remaining desired points in time and information regarding the closing of the valve V1 for the valve process. The valve process closes the valve V1 and generates a message with the remaining desired points in time and transfers this to the sensor process 38 to overcome the light barrier LS2. The valves V1 through V3 of the valve process are contained in the reservoir tray B for extraction of a single sheet. Identical valve processes and time processes that are executed in parallel with the valve process and the time process 34 are provided for the feeder trays Tray_A, Tray_C, Tray_D.

From the desired points in time transmitted by the valve process 36, the sensor process 38 determines a desired point in time at which the leading edge of the single sheet X must at the latest have arrived at the light barrier LS2. The sensor process 38, like the further sensor processes 40 and 42, serves to determine paper path errors. A high-precision time monitoring as it is used (with the help of an already-described time control unit) in the feeder units 10, 11 of the printer to control actuators and determine control points in time is not necessary for a paper path monitoring.

The sensor process 38 contains a time monitoring for monitoring of the desired time for arrival of the leading edge of the sheet of the single sheet X at the light barrier LS2. The sensor process 38 queries the current time in the time process 34 and forms a time difference with the aid of the transmitted desired value. This time difference is detected and monitored with the aid of a counter. After the passing of this count time, the maximum allowable paper delay until the light barrier LS2 is thus exceeded and the sensor process 38 generates an error message. Upon arrival of the leading sheet edge the light barrier LS2, a light barrier control unit generates an interrupt and executes an interrupt service routing. The interrupt service routing transfers a signal to the sensor process 38 via which the counter of the sensor process 38 is stopped or reset. Thus no error message is generated given timely arrival of the leading sheet edge of the single sheet X at the light barrier LS2.

After reaching the desired point in time of the sensor process 38, the sensor process 38 transfers (with the aid of a message) the remaining desired points in time to the sensor process 40 for monitoring of the light barrier LS7. In the same manner as the sensor process 38, the sensor process 40 determines a delay time before which the leading edge of the sheet must arrive at the light barrier LS7. Given an untimely arrival of the leading sheet edge at the light barrier LS7, the sensor process 40 generates an error message. The desired point in time is monitored by the sensor process 40 with the aid of a counter.

If the leading sheet edge of the single sheet X arrives at the light barrier LS7 in a timely manner, a monitoring unit generates an interrupt and executes an interrupt service routing. The interrupt service routing generates a signal for resetting or stopping the counter of the sensor process 40. The sensor process 40 subsequently transfers the desired value of the maximum allowable desired point in time for arrival of the leading sheet edge at the light barrier LS9 to the sensor process 42. The sensor process 40 monitors this desired value in the same manner as already described for the sensor processes 38 and 40. If the single sheet arrives at the light barrier LS9 in a timely manner, the sensor process 40 generates a message and transfers this to the superordinate module 32. If a sensor process 48, 40, 42 determines an error, the respective sensor process 38, 40, 42 generates a message with error information and then transfers this to the superordinate module 32.

In other exemplary embodiments, a separate time process is provided both for the valve process 36 and for the sensor processes 38, 40, 42 and for further processes such as, for example, the process to activate the step motor SM2B. The individual desired points in time are then no longer transferred from valve process 36 to time process 34 and from time process 34 to valve process 36, but rather are monitored together with the aid of a time process 34. Upon reaching a desired point in time, the process or processes affected by this desired point in time are informed or invoked with, for example, the aid of an interrupt. If a sensor process 38, 40, 42 is invoked by an interrupt, information is transferred from the sensor process 38, 40, 42 to the time process 34 which, if applicable, determines the time difference from the desired point in time. A control and/or regulation of the sheet position is then implemented using the deviation, as already described.

Figure 9:
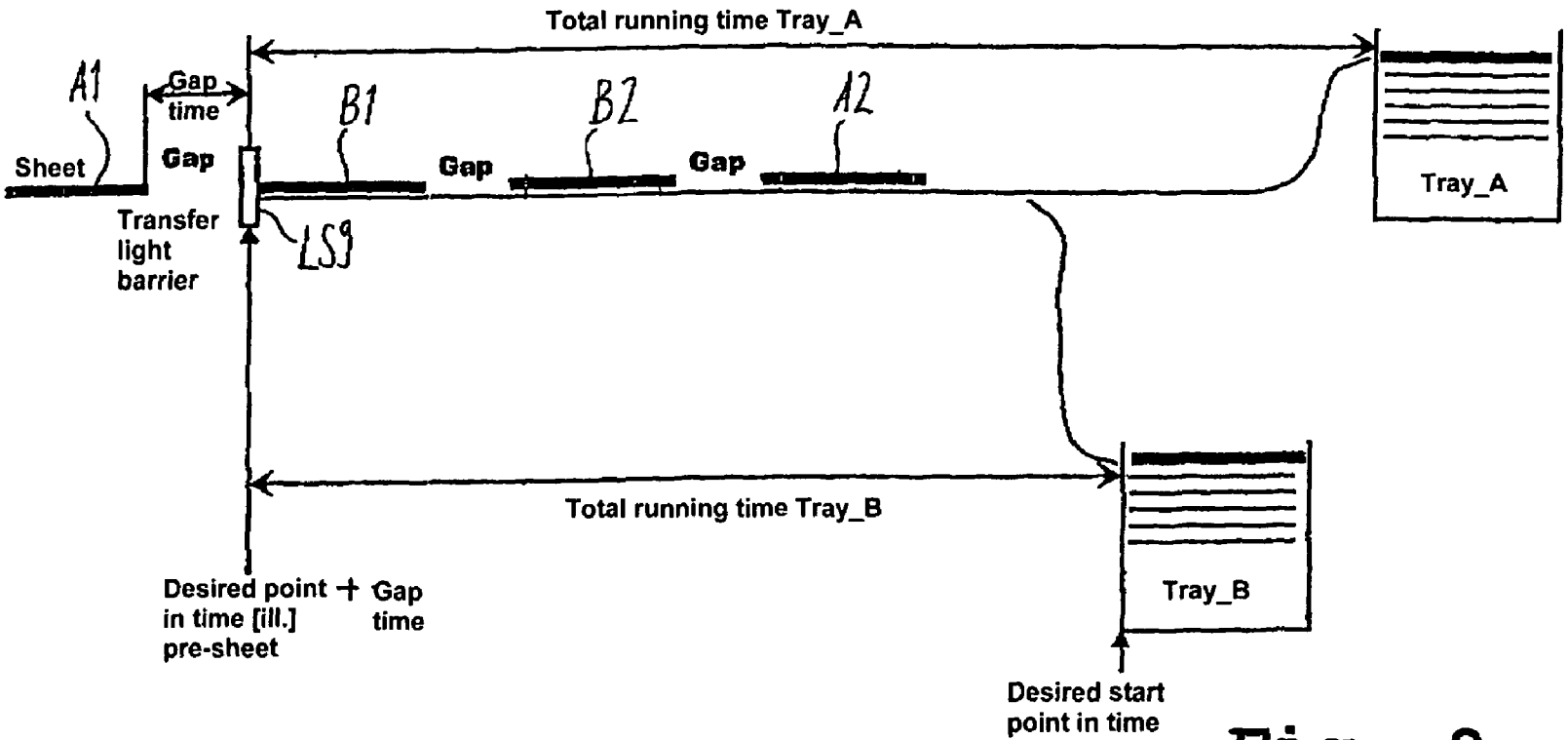
FIG. 9 is a diagram in which is shown the control of a sheet separation of successive single sheets with the aid of preset times.

FIG. 9 shows a time diagram in which are shown running times of single sheets from the extraction of single sheet from the reservoir tray Tray_A and the reservoir tray Tray_B up to the light barrier LS9. The desired start point in time for extraction of a single sheet B1 from the reservoir tray Tray_B results from the desired point in time of the trailing sheet edge of the single sheet A1 at the transfer light barrier LS9 and the sheet separation time from the single sheet B1. The sheet separation time, which is also designated as gap time, thereby determines the sheet separation between the single sheet A1 and the single sheet B1 given the constant transport speed $V_{TR}$. The total running time of the single sheet B1 from the reservoir tray Tray_B to the light barrier LS9 is to be subtracted from the sum made up of the desired point in time of the trailing sheet edge of the single sheet A1 and the gap time in order to determine the desired start point in time at which the sheet B1 must be extracted from the reservoir tray Tray_B so that the leading edge of the single sheet B1 reaches the light barrier LS9 after the trailing edge of the single sheet A1 has left the light barrier LS9, exactly before the gap time. If the desired point in time of the trailing sheet edge of the single sheet A1 at the light barrier LS9 has been determined, the total running time of the single sheet A1 from the reservoir tray Tray_A to the light barrier LS9 is added to the desired start point in time of the single sheet A1 and, furthermore, the format running time of the single sheet A1 is formed that results from the transport speed $V_{TR}$ and the sheet length of the single sheet A1. After the desired points in time have been determined, these are monitored by the time control unit 68.

Figure 10:
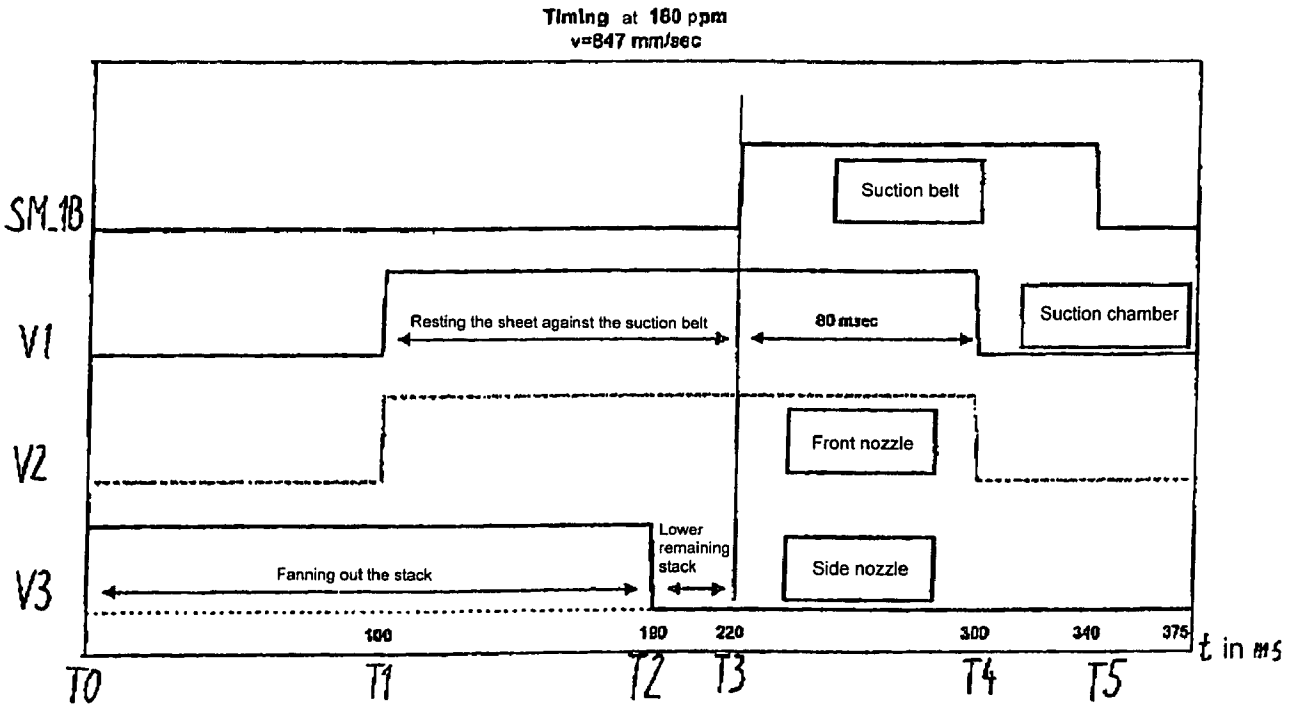
FIG. 10 is a diagram in which is shown the temporal control of valves and motors for extraction of a single sheet from the reservoir tray.

In FIG. 10, a diagram is shown that shows the workflow of the valve activation and the activation of the step motor SM1B of the suction belt SB_A of the reservoir tray Tray_A. The valve V3 is opened at the point in time T0, whereby the uppermost sheets of the stack of single sheets in the reservoir tray Tray_A are fanned out in order to subsequently be able to more easily extract the upper single sheet from the reservoir tray Tray_A. Given an opened valve V3, one or more nozzles that are laterally arranged on the upper edge of the paper stack in the reservoir tray Tray_A is [sic] supplied that then, as described, fan out the uppermost sheets of the stack.

At the point in time T1, after approximately 100 ms, the valve V2 is opened, whereby at least one front nozzle is supplied with compressed air. At the same time, at the point in time T1 the valve V1 is opened, via which suction air is applied on the suction belt SB_A. At the point in time T2, after approximately 190 ms, the valve V3 is closed and subsequently the remaining stack of single sheets sinks in the reservoir tray Tray_A. The single sheets below the upper single sheet, which rests against the suction belt SB_A due to the suction air, are separated from the upper single sheet via the air supplied via the front nozzle.

At the point in time T3, the single sheet rests against the suction belt SB_A and the remaining stack of single sheets has lowered. At this point in time, the step motor SM1B for driving the suction belt SB_A is started which accelerates the sheet uniformly to feed speed $V_{INPUT}$. The valve V1 and the valve V2 remain open up to the point in time T4, i.e. approximately until 300 ms after T0, in order to ensure that only the upper single sheet is removed from the reservoir tray Tray_A with the aid of the suction belt SB_A. At the point in time T5 the single sheet has already been transferred to the roller pair WP1 and the step motor SM1B is stopped. The time diagram according to FIG. 10 shows the time controller of the valves V1, V2, V3 and of the step motor SM1B given a transport speed $V_{TR}$ of 847 mm/s, at which 160 single sheets in DIN A4 paper format are supplied to the printer per minute by the feeder unit 11 according to FIG. 7.

Figure 11:
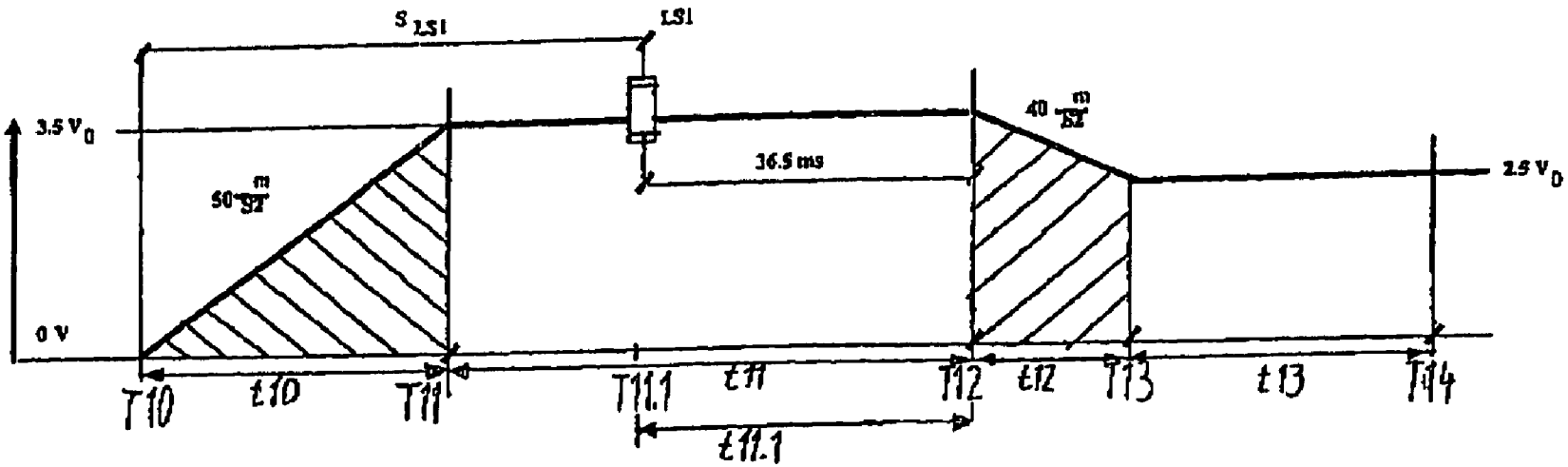
FIG. 11 is a speed/time diagram that shows the transport speed of the single sheet in the extraction from the reservoir tray.

A speed/time diagram is shown in FIG. 11 that shows the speed curve of a single sheet given the extraction from a reservoir tray Tray_A of the feeder unit 11 according to FIG. 7. At the point in time T10, the single sheet rests against the suction belt SB_A and the step motor SM1B to drive the suction belt SB_A is started. The step motor SM1B is thereby activated such that the suction belt SB_A is uniformly accelerated during the time span t10 with an acceleration of 50 $m/s^2$ to a speed of $3.5 \times v_0$. The speed $v_0$ is 338.6 mm/s in the present exemplary embodiment. The single sheet is forwarded with a constant speed $3.5 \times v_0$ up to the point in time T12. The point in time T11.1, at which the leading sheet edge of the single sheet reaches the light barrier LS1, is detected and compared with a predetermined desired point in time. Dependent on the comparison result, the time t11.1 (and thus the point in time T12) is established at which it is begun to reduce transport speed of the single sheet from $3.5 \times v_0$. The speed $3.5 \times v_0$ is the feed speed $V_{INPUT}$ of the single sheet. At the point in time T12, the single sheet is uniformly negatively accelerated (i.e. braked), with an acceleration of 40 m/s$^2$, to the transport speed $V_{TR}$ of 2.5×$v_0$. At the point in time T13, the single sheet has reached the normal transport speed $V_{TR}$ 2.5×$v_0$ and is forwarded with this speed up to the point in time T14, at which it reaches the transfer light barrier LS9. The following calculations result for the time spans T10 through T13:

$$v_0=338.6\text{ mm/s};\ 1_1=50\text{ m/s}^2;\ a_3=40\text{ m/s}^2;$$

$$t_{total}=t10+t11+t12+t13;\ a=\Delta V/t;\ t=s/V;$$

$$t10=\Delta v/a_1=3.5\times v_0/a_1=23/7\text{ ms};\ s10=a_1/2\times t10^2;\ s10=14.05\text{ mm};$$

$$t11=sLS1-s10/v+t11.1=sLS1-s10/3.5\times v_0+36.5\text{ ms};$$

$$s11=v\times t=3.5\times v_0\times t11;$$

$$t12=\Delta v/a_3=3.5\times v_0-2.5\times v_0/a_3;\ s12=a_3/2\times t12^2+2.5\times v_0\times t12;$$

$$t13=s4/v;\ s13=s_{total}-(s10+s11+s12);\ t13=s_{total}-(s10+s11+s12)/2.5\times v_0$$

Figure 12:
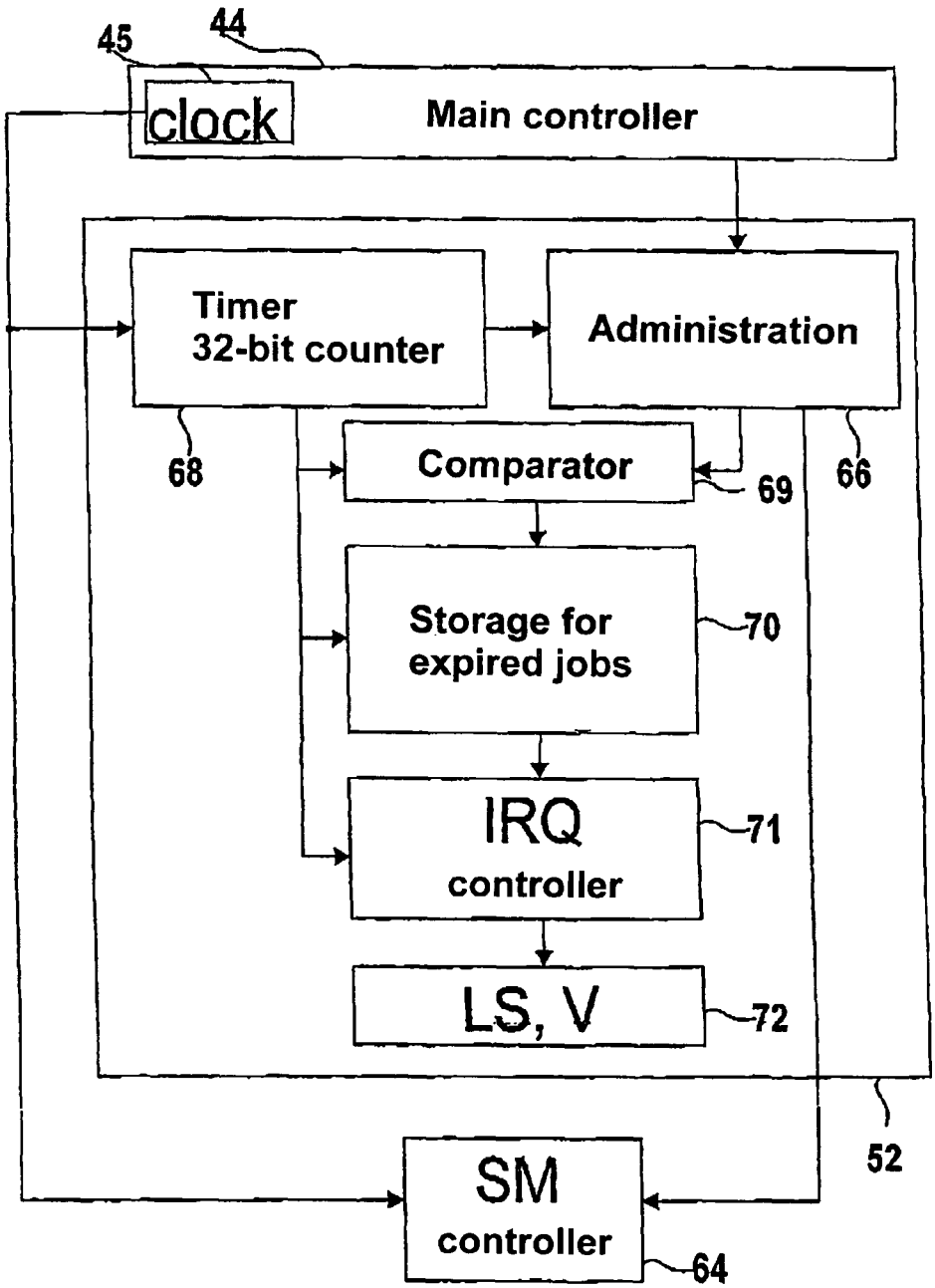
FIG. 12 is a block diagram with a control unit that contains a time control unit.

A block diagram of a control unit 52 is shown in FIG. 12 with a time control unit to establish and monitor desired points in time in the feeder unit 11 of the printer. The monitoring of the desired points in time occurs with the aid of a timer interrupt controller. This timer interrupt controller is executed in the present exemplary embodiment as a flex time control component with the designation EPF10K30AQC208-3 by the firm ALTERA. The timer interrupt controller contains a timer 68 with a 32-bit counter that is supplied a clock signal (100 kHz) of a clock signal generator 45 of the main controller 44. Furthermore, the timer interrupt controller comprises a comparator 69, a storage for expired jobs 70 and an interrupt controller 71.

As already described further above, the administration component 66 receives control data from the main controller 44. From these control data, the administration component 66 determines desired points in time for control of actuators and for monitoring of sensors. These desired points in time determined by the administration component 66 are supplied to the comparator 69 of the timer interrupt controller. The desired points in time are transferred to the comparator 69 as 32-bit count values. The comparator 69 stores the desired points in time and compares the transmitted desired points in time with the current count value of the timer 68. If a desired point in time agrees with the current count value, this information is stored with the aid of data in the storage 70. The interrupt controller 71 determines the desired points in time that have been reached and initiates an interrupt for implementation of the control action, i.e. for activation of an actuator or to establish the desired point in time of a sensor. The interrupt controller 71 executes an interrupt service routing and, dependent on the interrupt, transmits data for activation of actuators (in particular of valves) and for monitoring of sensors (in particular of light barriers) to an activation and monitoring unit 72.

The step motor controller 64 is likewise supplied the clock signal of the clock signal generator 45 of the main controller 44. Furthermore the next desired point in time for activation of the step motor activated by the step motor controller 64 is respectively transferred by the administration component 66 to the step motor controller. The step motor controller 64 contains its own time control unit for monitoring of the transmitted desired value. Upon reaching the desired value, the step motor controller 64 executes a corresponding control action. After reaching the desired value, the administration component 66 transmits (if applicable) a further desired value to the step motor controller 64. Alternatively, the timer 68 can also contain two cascaded 16-bit counters.

The desired points in time stored in the comparator 69 and in the storage 70 can be individually and/or collectively deleted by the main controller 44, for example after an occurred error. The checking and comparison of the desired points in time with the current time of the timer 68 occurs every 10 μs. If a plurality of desired points in time are simultaneously reached, information about reaching the desired points in time is stored in the storage 70 and successive corresponding interrupt service routings are initiated by the interrupt controller 71.

In embodiments, for example, light barriers or swing arm switches are used as sensors for position detection of single sheets. The swing arm switches have a mechanical activation element that extend into the transport path of the single sheet through the printer and are pushed away by a passing sheet, such that the swing arm switch outputs a sensor signal. If the sheet passes at the swing arm switch, a reset moment has the effect that the sensor arm of the swing arm switch extends again into the paper path and can be activated again by a next sheet. After the reset of the swing arm, a sensor signal is no longer output. Via such a swing arm switch, as with a light barrier the point in time at which a leading and/or trailing sheet edge arrives at the sensor can be exactly determines. Further sensors can also be position sensors of actuators such as, for example, position switches of step motors, gates, valves or of flaps of the printer or copier. To determine the exact points in time, it is thereby advantageous that all desired points in time and real points in time refer to the same time normal, for example the system time of the printer. If a plurality of control units are provided in the printer that respectively comprise a time control unit, a synchronization event is to be provided such that all time control units have the same system time. For example, with the help of a central clock signal clocked, cascaded counters can be used as timers of the time control units. Exactly the same reference time is thereby provided for all control units.

A plurality of processes can be provided for monitoring of sensor signals and for control of actuators, whereby a sensor is monitored by one process and at least one actuator is controlled via a second process. The processes can be executed in multitasking operation. A very simple control structure can thereby be realized with the aid of a control unit for control of a plurality of sensors and a plurality of actuators. Furthermore, it is advantageous to provide a separate time control process that at least compares two desired points in time with the real point in time and outputs an output signal upon reaching or exceeding the real point in time. It is thereby advantageous to provide the time control process for monitoring of up to 200 desired points in time. It is thereby achieved that the individual control units no long have monitor the desired points in time, whereby simple and cost-effective control units can be used.

In another exemplary embodiment, it is also advantageous to provide as an output signal of the time control process at least one interrupt signal that activates an interrupt service routing in the appertaining controller/in the corresponding controllers.

Figure 13:
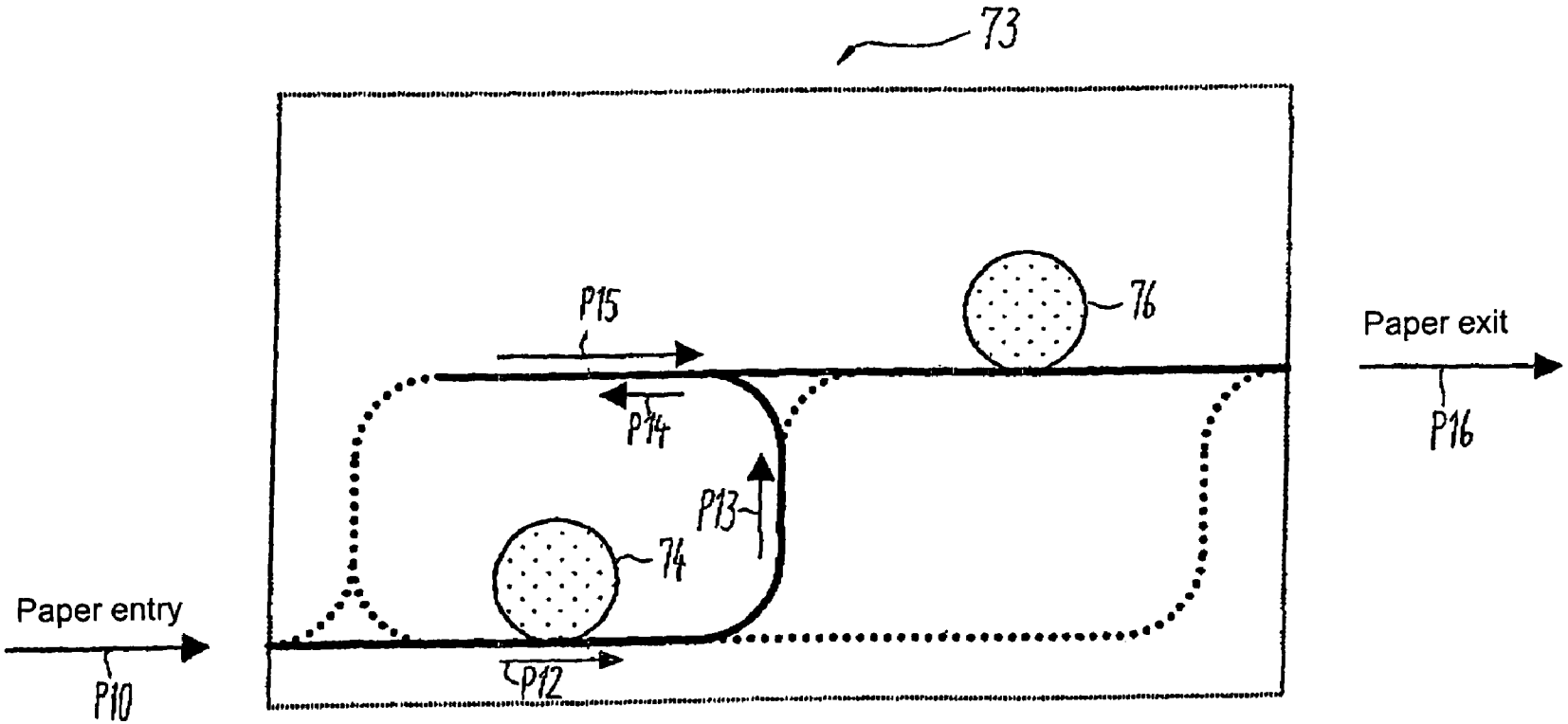
FIG. 13 shows the schematic representation of a printer with two printing groups according to a further aspect of the invention; whereby the paper path of a duplex operating mode of the printer is shown.

A printer 73 with a first printing group 74 and a second printing group 76 is shown in FIG. 13. The printer 73 is operated in a first operating mode. A single sheet (not shown) is supplied to the printer 73 in the direction of the arrow P10. Possible transport paths of the single sheet through the printer 73 are shown with dotted lines, whereby the supplied single sheet is passed on these transport paths to the printing group 74 and/or to the printing group 76 for printing of the single sheet with one or more print images. The actual transport path of the supplied single sheet in the first operating mode is shown indicated by the arrows P12 through P15 and as a solid line.

The single sheet supplied to the printer 73 in the direction of the arrow P10, for example from a feeder device 11, is directed to the printing group 74 and is printed by this on the front side with a first print image. The single sheet is subsequently forwarded in the direction of the arrows P13 and P14 and subsequently in the direction of the arrow P15 to the printing group 76. The printing group 76 generates a second image on the back side of the single sheet. In the region of the arrows P14 and P15, the single sheet is turned in order to supply it to the printing group 76 with a back side facing towards the printing group 76. In this first operating mode shown in FIG. 13, the printer 73 can print successive front side and rear sides of the supplied single sheet, for example in the same color.

Figure 14:
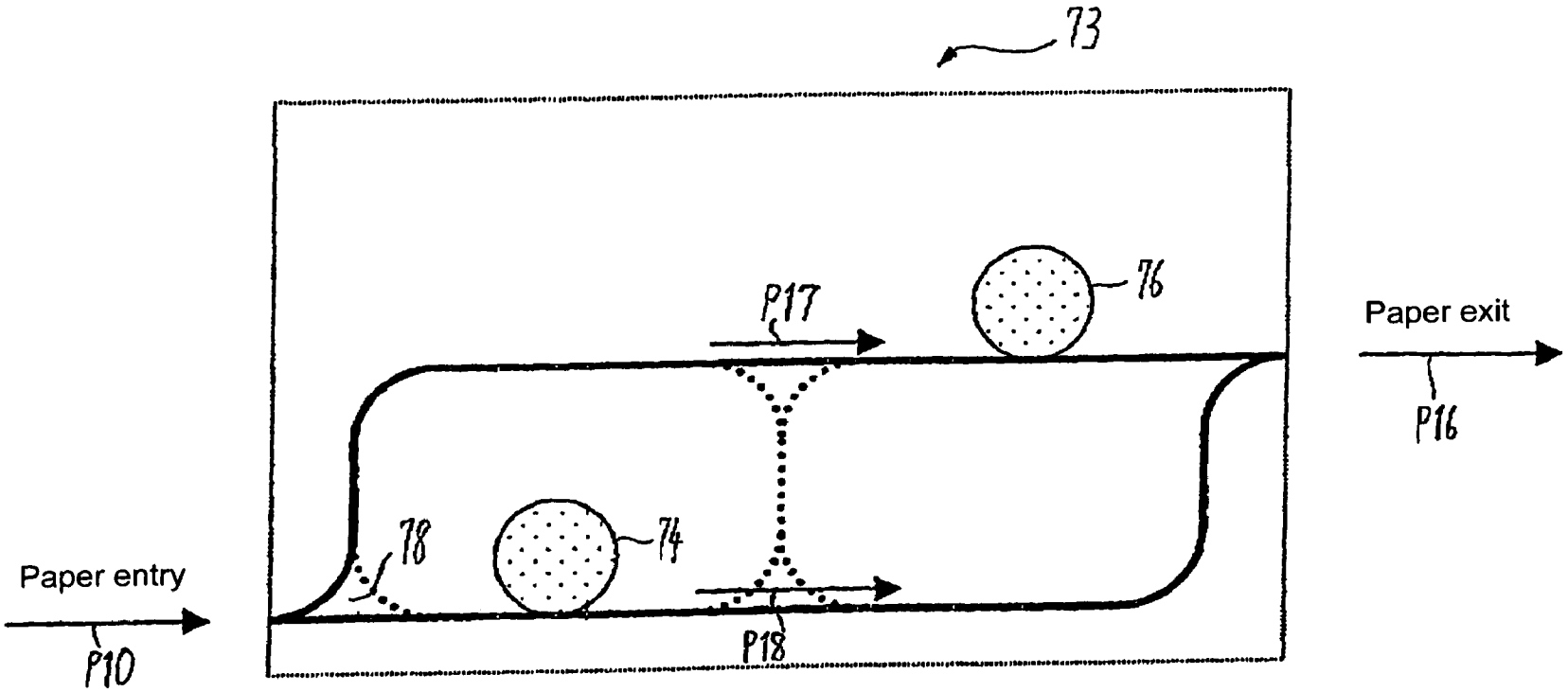
FIG. 14 is a schematic representation of the printer according to FIG. 14, whereby the paper paths of a simplex operating mode of the printer are shown.

The printer 73 according to FIG. 13 is shown in FIG. 14, whereby the printer 73 is shown in a second operating mode for one-sided printing of single sheets. Identical elements have the same reference characters. The single sheets are supplied to the printer 73 in the direction of the arrow P10, as already described in connection with FIG. 14. At a gate 78, the supplied single sheet can be transported to an upper transport path along the solid line in the direction of the arrow P17 or along the solid line in the direction of the arrow P18 to a lower paper path through the printer 73. If a first single sheet is transported along the lower paper path P18 through the printer 73, it is thereby supplied to the printing group 74 which generates a predetermined first print image on the first single sheet. If a second single sheet is transported along the upper paper path in the direction of the arrow P17 through the printer 73, it is supplied to the printing group 76 which generates a second print image on the supplied side of the second single sheet. The single sheets are output from the printer 73 in the direction of the arrow P16 after the printing.

If the printer 73 is operated in the operating mode according to FIG. 14 and a plurality of single sheets should be printed in succession, it is advantageous to transport the first single sheet along the lower paper path through the printer 72 and the second single sheet along the upper paper path through the printer 73. An optimal loading of the printer 73 for one-sided printing of print pages is thereby achieved, since the printing groups 74, 76 can essentially print different single sheets in parallel.

With the help of the supplied print data, the main controller 64 determines the transport path of the single sheet through the printer 73 and establishes the operating mode in which the printer 73 is operated for printing of the single sheet. A printer with two printing groups and a method for operation of such a printer is known from the document WO 98/18052. The printer can thereby be operated in a first operating mode, what is known as a duplex operating mode in which the first printing group generates a first print image on the front side of a supplied single sheet and the second printing group generates a second print image on the back side of the single sheet.

In a second operating mode, what is known as a fast simplex operation mode, a first single sheet is supplied to the first printing group 74 on a first transport path for printing of the front side and a second single sheet is supplied to the second printing group 76 on a second transport path for printing of the front side of the second single sheet. It is thereby possible to essentially simultaneously print two one-sided single sheets to be printed and to increase the printing speed in the one-sided printing of single sheets relative to the first duplex operating mode. However, a switch-over time is necessary to switch from the first operating mode to the second operation mode as well as from the second operating mode to the first operation mode. A device and a method in order to shorten the switch-over time is described in the patent application (submitted at the same time as this patent application) by the same applicant with the file number DE 102 50 185.8. However, minimum sheet separations must be maintained in the switch-over of the operating modes. The content of this patent application is incorporated by reference into the present specification.

If a single sheet is printed on both sides in the first operating mode and subsequent single sheets should only be printed on one side, the switch from the first operating mode to the second operating mode is only made in the preferred embodiment when a preset number of successive single sheets is to be printed one-sided. The optimal number to be preset is thereby based on the design of the printer 73, in particular on the paper format, on the necessary minimum sheet separation in the switch-over between the operating modes and on the printing speed differences between the one-sided printing of single sheets in the duplex operating mode and in the fast simplex operating mode. In both the calculation and in test series with the printer 73, it has proven to be advantageous to preset a value in the range between four and twenty DIN A4 single sheets for the number to be set of the pages to printed one-sided. The value ten has proven to be particularly advantageous.

A table is shown in FIG. 15 in which the operating mode selection of the printer 73 is shown dependent on the number of the pages to be printed in the respective operating mode. The single sheets to be printed in succession are specified in a consecutive numbering in column 1 of the table. Whether the respective sheet is to be printed one-sided or on both sides is specified in column 2 of the table according to FIG. 15. The tentatively selected transport path is specified in column 3 of the table. An explanation for selection of the transport path of the respective single sheet is specified in column 4 of the table. The paper paths changed after a re-evaluation (i.e. after reaching the determined number of successive single sheets to be printed one-sided) are specified in column 5 of the table and the operating mode in which the respective single sheet is printed by the printer 73 is specified in column 7 of the table.

The first single sheet 1 is to be printed one-sided. A transport path is selected on which the single sheet 1 is to be printed one-sided by the printing group 74. The single sheet 2 is likewise to be printed one-sided. A transport path is selected in which it is transported to the printing group 76 and printed by this. The third single sheet is likewise to be printed one-sided and is transported on the same transport path as the single sheet 1 through the printer 73 to the printing group 74 and printed one-sided by this. The printing of the single sheets 1 through 3 occurs in the operating mode 2, i.e. the fast simplex operating mode.

The fourth single sheet 4 is to be printed double-sided. A switch must thus be made from the operating mode 2 to the operating mode 1 for two-sided printing, whereby the single sheet 4 is transported on the transport path through the printer 73 on which it is transported with the front side to the printing group 74 and with the back side to the printing group 76. The single sheet 5 is to be printed one-sided. A control unit for selection of the operating mode checks whether the preset number of ten successive single sheets to be printed one-sided has already been reached, which number is necessary in order to switch the operating mode from the operating mode 2 to the operating mode 1. The single sheet 5 is the first single sheet to be printed one-sided after the single sheet 4 to be printed double-sided. As specified in column 3, the operating mode 2 is thus maintained, whereby only the printing group 74 or only the printing group 76 generates a print image on the front side of the single sheet 5.

The single sheets 6 through 13 are likewise only to be printed one-sided. With each single sheet 6 through 13, the control unit continuously checks whether the preset number of successive single sheets to be printed one-sided has already been reached or exceeded. The single sheet 14 is likewise to be printed one-sided. The control unit for selection of the operating mode determines that the preset number of ten single sheets has been reached with the single sheet 14 since the single sheets 5 through 14, i.e. ten successive single sheets, are to be printed one-sided. The control unit establishes that the single sheets 5 through 14 are not to be printed in the operating mode 1 (as originally selected for the single sheets 5 through 13) but rather in the operating mode 2. The transport path through the printer is re-determined for the single sheets 5 through 13. For the single sheet 5, a transport path is selected that transports the single sheet to the printing group 74, whereby for the single sheet 4 a larger minimum separation (necessary for the switch-over of the operating modes) is set to be maintained for the sheet separation between the single sheets 4 and 5. The successive single sheets 6 through 14 are then alternately supplied to the printing group 74 or 76, as specified in the column 5 or in the column 3 for the single sheets 14.

The successive single sheet 15 is likewise to be printed one-sided and is supplied to the printing group 74 for printing. The single sheets 5 through 15 are thus printed in the fast simplex operating mode by the printer 73. The single sheet 16 is to be printed two-sided. The operating mode for printing of the single sheet 16 is thus switched from the operating mode 2 to the operating mode 1. The necessary minimum sheet separation between single sheet 15 and single sheet 16 is thus provided in the switch-over from the operating mode 2 to the operating mode 1. The single sheets 17 and 18 are to be printed two-sided, like the single sheet 16, whereby the operating mode 1 is maintained.

Generally stated, the subsequent print sides to be printed are pending in the control unit for selection of the operating mode of the printer 73. The control unit thus has a leader of single sheets to be printed. The control unit associates a transport path with each sheet for generation of the desired print image or of the desired print images on the single sheet and establishes a sheet separation from the preceding single sheet. This occurs at least before the appertaining single sheet is supplied to the printer 73 or, respectively, before the single sheet is extracted from a reservoir tray Tray_A through Tray_D of the feeder unit 11 of the printer 73. The printing of a single sheet is thereby considered as a printing event. Via the analysis by the control unit of the pending pages contained in the leader, the evaluation for operating mode selection (explained in connection with FIGS. 13 through 15) can occur in that the performance of the printer 73 can be significantly increased. The switch between the operating modes occurs with an increase of the printing speed relative to conventional printers with a reduction of the wear of the components participating in the operating mode switch.

The method of the preferred embodiment for switch-over of the operating modes is then particularly to be advantageously used when a continuous transport of the single sheets occurs through the printer 73 without what are known as stop positions being contained in the transport path. A significant increase of the printing speed can in particular be achieved in such printers.

In the printer according to FIGS. 13 and 14, it is advantageous to stored the print data of at least the preset number in a storage of the printer, which data are then evaluated by the control unit.

Although preferred exemplary embodiments are shown and described in detail in the drawings and in the preceding specification, these should be viewed as purely exemplary and not as limiting the invention. It is noted that only the preferred exemplary embodiments are shown and described, and all variations and modifications that presently and in the future lie within the scope of protection of the invention should be protected.

We claim as our invention:

1. A method for control of a printer to process a print job, comprising the steps of:

by a first controller of the printer generating a system time of the printer that is the same for at least first and second subordinate control modules of the printer, the first and second subordinate control modules being subordinate to said first controller;

providing a print data stream of said print job to a second controller;

processing said print data stream in said second controller and during said processing determining single-sheet-related information from the print data stream;

transferring said single-sheet-related information from said second controller to said first controller;

dependent on said single-sheet-related information, by said first controller determining a transport path of the single sheet through the printer to generate at least one print image on at least one side of the sheet;

with said first subordinate control module calculating during said processing of said print job for control of said single sheet a first desired point in time at or until which at least a first sensor signal is expected to be generated by detection of a leading edge of said single sheet from a first sensor;

with said first subordinate control module calculating during said processing of said print job for control of said single sheet a second desired point in time at or until which at least a second sensor signal is expected to be generated by detection of said leading edge of said single sheet from a second sensor;

said first and second desired points in time being referenced to said system time of the printer;

with said second subordinate control module calculating during said processing of said print job for control of said single sheet at least a third desired point in time at or until which a first actuator is to be activated;

with said second subordinate control module calculating during said processing of said print job for control of said single sheet at least a fourth desired point in time at or until which a second actuator is to be activated;

said at least third and fourth desired points in time being referenced to said system time of the printer or copier;

transferring said desired first, second, third and fourth points in time from said first and second subordinate control modules to a time process task in said first controller;

in at least one sensor determination process determining which one of said first and second desired points in time is to be used in determining when said leading edge of said single sheet is to arrive at said first sensor and monitoring the arrival of said leading edge at said first sensor, said sensor determination process being handled and executed as a sensor task in said first controller;

in at least one actuator determination process determining which of said at least third and fourth desired points in time is to be used in determining when said first actuator is to be activated, said actuator determination process being handled and executed as an actuator task in said first controller;

said time process task, said sensor task, and said actuator task being handled as independent tasks in a multitasking operation of said first controller, the multitasking operation processing capacity of said first controller being allocated among said process task, said sensor task, and said actuator task in time slots;

said time process task transferring the desired first, second, third and fourth points in time to said actuator task and to a time control unit, the time control unit being separate from the first controller and separate from the first and second subordinate control modules;

upon reaching one of said first through fourth desired points in time, said time control unit providing an interrupt signal and transmitting the interrupt signal to said time process task;

upon receiving said interrupt signal, said time process task generating at least one message for at least one of said actuator task and said sensor task;

upon receipt of a first message for said first actuator from said time process task when said third desired point in time has been reached said actuator task initiating a first action of the first actuator;

upon receipt of a second message for said second actuator from said time process task when said fourth desired point in time has been reached said actuator task initiating a second action of the second actuator;

the actuator task transmitting the remaining first and second desired points in time to said sensor task; and upon receipt of a third or a fourth message for said first or second sensors from said time process task when said first or second desired points in time have been reached monitoring arrival of said edge by said first or second sensor.

2. The method according to claim 1 wherein the system time is predetermined by a timer with help of a counter that counts a clock signal with a constant frequency.

3. The method according to claim 1 wherein the first or second sensors comprise a light barrier or a swing arm switch by which the first or the second sensor signal is output upon arrival of the sheet edge.

4. The method according to claim 1 wherein the actuator comprises a step motor or a valve.

* * * * *